US011133161B2

(12) United States Patent
Bazargan et al.

(10) Patent No.: US 11,133,161 B2
(45) Date of Patent: Sep. 28, 2021

(54) METHODS AND SYSTEMS FOR QUANTIFYING TWO OR MORE ANALYTES USING MASS SPECTROMETRY

(71) Applicant: PERKINELMER HEALTH SCIENCES CANADA, INC., Woodbridge (CA)

(72) Inventors: Samad Bazargan, Brampton (CA); Hamid Badiei, Woodbridge (CA)

(73) Assignee: PerkinElmer Health Sciences Canada, Inc., Woodbridge (CA)

( * ) Notice: Subject to any disclaimer, the term of this patent is extended or adjusted under 35 U.S.C. 154(b) by 0 days.

(21) Appl. No.: 16/920,887

(22) Filed: Jul. 6, 2020

(65) Prior Publication Data

US 2021/0074533 A1 Mar. 11, 2021

Related U.S. Application Data

(63) Continuation of application No. PCT/IB2019/050110, filed on Jan. 7, 2019.

(60) Provisional application No. 62/614,888, filed on Jan. 8, 2018.

(51) Int. Cl.
*H01J 49/00* (2006.01)
*H01J 49/04* (2006.01)

(52) U.S. Cl.
CPC ..... *H01J 49/0077* (2013.01); *H01J 49/0422* (2013.01)

(58) Field of Classification Search
CPC ..... H01J 49/0077; H01J 49/0422
USPC ..... 250/281, 282, 283
See application file for complete search history.

(56) References Cited

U.S. PATENT DOCUMENTS

| | | | | |
|---|---|---|---|---|
| 8,525,107 | B2 * | 9/2013 | Bandura | H01J 49/004 250/282 |
| 2011/0062322 | A1 * | 3/2011 | Franzen | G01N 27/622 250/282 |
| 2020/0161113 | A1 * | 5/2020 | Shichi | H01J 49/022 |
| 2020/0217828 | A1 * | 7/2020 | Regittnig | G01N 33/583 |

* cited by examiner

*Primary Examiner* — Nicole M Ippolito
(74) *Attorney, Agent, or Firm* — Rhodes IP PLC; Christopher R Rhodes

(57) ABSTRACT

Certain embodiments described herein are directed to methods and systems of detecting two or more analytes present in a single system such as a nanoparticle or nanostructure. In some examples, the methods and systems can estimate data gaps and fit intensity curves to obtained detection values so the amount of the two or more analytes present in the single system can be quantified.

20 Claims, 14 Drawing Sheets

METHODS AND SYSTEMS FOR QUANTIFYING TWO OR MORE ANALYTES USING MASS SPECTROMETRY

TECHNOLOGICAL FIELD

This application is directed to methods and systems of quantifying two or more analytes using mass spectrometry. In certain configurations, methods and systems of filling in mass spectrometry data gaps when detecting two or more different analytes in a transient sample to permit quantitation of each of the two or more different analytes are described.

BACKGROUND

In many mass spectrometry methods, a sample is introduced into an ionization source to ionize species in the sample. An analyte ion to be detected can be selected or filtered from other ions in the sample prior to providing the analyte ion of interest to a detector.

SUMMARY

In an aspect, a method of quantifying a transient event representative of two or more analytes in a transient sample using a mass spectrometer is provided.

In certain configurations, the method comprises broadening an ion cloud by differentially decreasing an ion velocity of different analyte ions in an ion cloud in a collision-reaction cell. The ion cloud may comprise ions from a first analyte of the transient sample and ions from a second analyte of the transient sample. For example, the ion velocities of different ions can be differentially decreased by pressurizing the collision-reaction cell with a gas.

In other configurations, the method may comprise providing the broadened ion cloud comprising the different ions of differentially decreased ion velocity from the collision-reaction cell to a mass analyzer fluidically coupled to the collision-reaction cell downstream of the collision-reaction cell to alternately select between the ions from the first analyte and the ions from the second analyte using the mass analyzer.

In some configurations, the method may comprise providing the alternately selected ions from the first analyte and the ions from the second analyte from the mass analyzer to a downstream detector fluidically coupled to the mass analyzer to detect the provided ions from the first analyte as first detection values during a detection period and to detect the provided ions from the second analyte as second detection values during the detection period.

In additional configurations, the method may comprise generating a first intensity curve, using the detected first detection values, that is representative of the first analyte in the sample, and generating a second intensity curve, using the detected second detection values, that is representative of the second analyte in the sample.

In some instances, the method may comprise determining an amount of the first analyte in the transient sample using the generated first intensity curve and determining an amount of the second analyte in the transient sample using the second generated intensity curve.

In some examples, the method comprises using a first analyte pre-scan curve to determine a shape of the generated first intensity curve and using a second analyte pre-scan curve to determine a shape of the second generated intensity curve. In other examples, the method comprises using peak height of the first generated intensity curve to determine the amount of first analyte. In some instances, the method comprises using peak height of the second generated intensity curve to determine the amount of second analyte. In other instances, the method comprises using area under the generated first intensity curve to determine the amount of first analyte. In some examples, the method comprises using area under the generated second intensity curve to determine the amount of second analyte.

In other configurations, the method comprises altering an axial field strength within the collision-reaction cell to further broaden the ion cloud in the collision-reaction cell. For example, the method may comprise lowering a voltage provided to axial electrodes, e.g., two or more axial electrodes, within the collision-reaction cell to alter the axial field strength within the collision-reaction cell.

In some configurations, the method may comprise altering a sampling depth of the mass spectrometer to further broaden the ion cloud.

In certain examples, the method comprises configuring the transient sample to comprise a single nanoparticle, a single nanostructure, a single microparticle, a single microstructure, a single cell or a single organelle of a cell.

In another aspect, a method of quantifying two or more inorganic analytes in a transient sample using a mass spectrometer, wherein the transient sample comprises a first inorganic analyte and a second inorganic analyte each present in a single system is described.

In certain embodiments, the method comprises introducing the single system into an ionization source to ionize the first inorganic analyte and the second inorganic analyte and provide an ion cloud comprising ionized first inorganic analyte and ionized second inorganic analyte.

In some examples, the method comprises providing the ion cloud comprising the ionized first inorganic analyte and the ionized second inorganic analyte to a collision-reaction cell fluidically coupled to the ionization source and downstream from the ionization source.

In certain examples, the method may comprise broadening the provided ion cloud in the collision-reaction cell;

In certain instances, the method comprises providing the broadened ion cloud from the collision-reaction cell to the mass analyzer fluidically coupled to the collision-reaction cell downstream of the collision-reaction cell to alternately select between ions from the ionized first inorganic analyte and ions from the ionized second inorganic analyte using the mass analyzer.

In other instances, the method comprises providing the alternately selected ions from the ionized first inorganic analyte and the ions from the ionized second inorganic analyte from the mass analyzer to a downstream detector fluidically coupled to the mass analyzer to detect the provided ions from the ionized first inorganic analyte as first detection values during a detection period and to detect the ions from the provided ionized second inorganic analyte as second detection values during the detection period.

In some examples, the method comprises generating a first intensity curve, using the detected first detection values, that is representative of the first inorganic analyte in the single system, and generating a second intensity curve, using the detected second detection values, that is representative of the second inorganic analyte in the single system.

In certain examples, the method comprises determining an amount of the first analyte in the single system using the generated first intensity curve and determining an amount of the second analyte in the single system using the generated second intensity curve.

In some examples, the method comprises broadening the provided ion cloud in the collision-reaction cell by altering pressure in the collision-reaction cell or altering axial field strength in the collision-reaction cell or both to differentially decrease ion velocity of ions in the provided ion cloud.

In other examples, the method comprises using a first analyte pre-scan curve to determine a shape of the generated first intensity curve and using a second analyte pre-scan curve to determine a shape of the second generated intensity curve. In some examples, the method comprises using peak height of the first generated intensity curve to determine the amount of first analyte, and using peak height of the second generated intensity curve to determine the amount of second analyte. In other examples, the method comprises using area under the generated first intensity curve to determine the amount of first analyte. In certain embodiments, the method comprises using area under the generated second intensity curve to determine the amount of second analyte.

In some embodiments, the method comprises altering a sampling depth of the mass spectrometer to broaden the ion cloud prior to providing the ion cloud to the collision-reaction cell.

In certain embodiments, the method comprises providing the ion cloud to an ion deflector positioned upstream of the collision-reaction cell.

In other embodiments, the method comprises configuring the single system to comprise a single nanoparticle, a single nanostructure, a single microparticle, a single microstructure, a single cell or a single organelle of a cell.

In an additional aspect, a method of quantifying two or more inorganic analytes in a single system using a mass spectrometer is provided. For example, the single system comprises a first inorganic analyte in the single system and a second inorganic analyte in the single system.

In certain examples, the method comprises introducing the single system into an ionization source to ionize the first inorganic analyte and the second inorganic analyte and provide an ion cloud comprising ions from the ionized first inorganic analyte and ions from the ionized second inorganic analyte.

In some examples, the method comprises providing the ion cloud comprising the ions from the ionized first inorganic analyte and the ions from the ionized second inorganic analyte to a collision-reaction cell fluidically coupled to the ionization source and downstream from the ionization source.

In other examples, the method comprises broadening the provided ion cloud in the collision-reaction cell.

In some instances, the method comprises providing the broadened ion cloud from the collision-reaction cell to a mass analyzer fluidically coupled to the collision-reaction cell downstream of the collision-reaction cell to alternately select between the ions from the ionized first inorganic analyte and the ions from the ionized second inorganic analyte using the mass analyzer.

In some instances, the method comprises providing the alternately selected ions from ionized first inorganic analyte and the ions from ionized second inorganic analyte from the mass analyzer to a downstream detector fluidically coupled to the mass analyzer to detect the provided ions from the ionized first inorganic analyte as first detection values during a detection period and to detect the provided ions from the ionized second inorganic analyte as second detection values during the detection period.

In other examples, the method comprises generating a first intensity curve, using the detected first detection values, that is representative of the first inorganic analyte in the single system, and generating a second intensity curve, using the detected second detection values, that is representative of the second inorganic analyte in the single system.

In some embodiments, the method comprises determining an amount of the first analyte in the single system using the generated first intensity curve and determining an amount of the second analyte in the single system using the generated second intensity curve.

In certain instances, the method comprises configuring the ionization source as an inductively coupled plasma.

In other examples, the method comprises broadening the provided ion cloud in the collision-reaction cell by altering pressure in the collision-reaction cell or altering axial field strength in the collision-reaction cell or both to differentially decrease ion velocity of ions in the provided ion cloud.

In certain examples, the method comprises altering a sampling depth to broaden the ion cloud prior to providing the ion cloud to the collision-reaction cell.

In other examples, the method comprises providing the ion cloud to an ion deflector positioned between the ionization source and the collision-reaction cell.

In some embodiments, the method comprises using a first analyte pre-scan curve to determine a shape of the generated first intensity curve and using a second analyte pre-scan curve to determine a shape of the second generated intensity curve.

In certain examples, the method comprises using peak height of the first generated intensity curve to determine the amount of first analyte and using peak height of the second generated intensity curve to determine the amount of second analyte. In some examples, the method comprises configuring the single system to comprise a single nanoparticle, a single nanostructure, a single microparticle, a single microstructure, a single cell or a single organelle of a cell.

In other examples, the method comprises using area under the generated first intensity curve to determine the amount of first analyte and using area under the generated second intensity curve to determine the amount of second analyte. In some examples, the method comprises configuring the single system to comprise a single nanoparticle, a single nanostructure, a single microparticle, a single microstructure, a single cell or a single organelle of a cell.

In another aspect, a method of quantifying two or more inorganic analytes in a transient sample using a mass spectrometer is provided. For example, the transient sample comprises each of a first inorganic analyte and a second inorganic analyte present in a single system.

In certain embodiments, the method comprises introducing the single system into an ionization source to ionize the first inorganic analyte and the second inorganic analyte and provide an ion cloud comprising ionized first inorganic analyte and ionized second inorganic analyte.

In other embodiments, the method comprises providing the ion cloud to a mass analyzer downstream of the ionization source to alternately select between ions from the ionized first inorganic analyte and ions from the ionized second inorganic analyte using the mass analyzer.

In some embodiments, the method comprises providing the alternately selected ions from the ionized first inorganic analyte and the ions from the ionized second inorganic analyte from the mass analyzer to a downstream detector fluidically coupled to the mass analyzer to detect the provided ions from the ionized first inorganic analyte as first detection values during a detection period and to detect the ions from the provided ionized second inorganic analyte as second detection values during the detection period.

In certain examples, the method comprises generating a first intensity curve, using the detected first detection values, that is representative of the first inorganic analyte in the single system, and generating a second intensity curve, using the detected second detection values, that is representative of the second inorganic analyte in the single system.

In some embodiments, the method comprises determining an amount of the first analyte in the single system using the generated first intensity curve and determining an amount of the second analyte in the single system using the generated second intensity curve.

In certain examples, the method comprises configuring the ionization source to comprise a laser to ablate the single system to provide the ion cloud as a plume of solid sample formed by the laser ablation, wherein the plume of solid sample comprises the first inorganic analyte and the second inorganic analyte.

In other examples, the method comprises configuring the ionization source to comprise an electrothermal vaporizer to provide the ion cloud as a vapor plug formed by electrothermal vaporization, wherein the vapor plug comprises the first inorganic analyte and the second inorganic analyte.

In some examples, the method comprises using a first analyte pre-scan curve to determine a shape of the generated first intensity curve and using a second analyte pre-scan curve to determine a shape of the second generated intensity curve. In other examples, the method comprises using peak height of the first generated intensity curve to determine the amount of first analyte and using peak height of the second generated intensity curve to determine the amount of second analyte.

In other examples, the method comprises using area under the generated first intensity curve to determine the amount of first analyte and using area under the generated second intensity curve to determine the amount of second analyte.

In some embodiments, the method comprises altering a sampling depth of the mass spectrometer to broaden the ion cloud prior to providing to providing the ion cloud to the downstream mass analyzer.

In certain examples, the method comprises providing the ion cloud to an ion deflector positioned downstream of the ionization source.

In some examples, the method comprises providing the ion cloud to a collision-reaction cell positioned between the ion deflector and the mass analyzer.

In other examples, the method comprises configuring the collision-reaction cell with a quadrupole rod set and two or more axial electrodes.

In an additional aspect, a method of correcting for data gaps during alternate detection of two or more analytes comprising a first analyte and a second analyte present in a transient sample to permit quantitation of each of the first analyte and the second inorganic analyte using a mass spectrometer is disclosed.

In certain embodiments, the method comprises alternately detecting ions from ionized first analyte and ions from ionized second analyte during a broadened detection interval, wherein during the broadened detection interval a number of non-zero detection values detected for each of the ionized first analyte and the ionized second analyte is greater when compared to a number of non-zero detection values detectable for each of the ionized first analyte and the ionized second analyte within a non-broadened detection interval.

In some examples, the method comprises broadening the detection interval by broadening an ion cloud comprising ions from ionized first analyte and ions from ionized second analyte.

In other examples, the method comprises broadening the ion cloud in a collision-reaction cell by altering pressure in the collision-reaction cell or altering axial field strength in the collision-reaction cell or both.

In certain embodiments, the method comprises broadening the ion cloud by altering a sampling depth of the mass spectrometer.

In certain examples, the method comprises using detection values from the alternately detected ions from ionized first analyte and ions from ionized second analyte during the broadened detection interval to quantify an amount of each of the first analyte and the second analyte in the transient sample.

In certain embodiments, the method comprises generating a first intensity curve using the detection values from the detected ions from ionized first analyte.

In other embodiments, the method comprises generating a second intensity curve using the detection values from the detected ions from ionized second analyte.

In some embodiments, the method comprises using a first analyte pre-scan curve to determine a shape of the generated first intensity curve and using a second analyte pre-scan curve to determine a shape of a second generated intensity curve.

In other embodiments, the method comprises selecting a single system comprising the first analyte and the second analyte, wherein the single system comprises a single nanoparticle, a single nanostructure, a single microparticle, a single microstructure, a single cell or a single organelle of a cell.

In some examples, the method comprises selecting a single system comprising the first analyte and the second analyte, wherein the single system provides a plume of solid sample formed by the laser ablation or wherein the single system provides a vapor plug formed by electrothermal vaporization.

In another aspect, a mass spectrometer system configured to quantify an amount of a first analyte and an amount of a second analyte in a transient sample is provided.

In certain examples, the system comprises an ionization source configured to generate an ion cloud comprising ions from the first analyte and ions from the second analyte. In other examples, the system comprises an interface fluidically coupled to the ionization source, the interface configured to sample the generated ion cloud. In some examples, the system comprises a collision-reaction cell fluidically coupled to the interface, the collision-reaction cell configured to receive the sampled, generated ion cloud and configured to receive a gas to pressurize the collision-reaction cell to broaden the sampled, generated ion cloud in the collision-reaction cell. In some instances, the system comprises a mass analyzer fluidically coupled to the collision-reaction cell and configured to receive the broadened ion cloud from the collision-reaction cell, the mass analyzer configured to alternately select ions from the first analyte and the ions from the second analyte. In certain examples, the system comprises a detector configured to receive the alternately selected ions from the mass analyzer and detected received ions from the first analyte as first detection values during a detection period and to detect received provided ions from the second analyte as second detection values during the detection period. In some instances, the system comprises a processor configured determine an amount of the first analyte in the transient sample using the first detection values and configured to determine an amount of the second analyte in the transient sample using the second detection values.

In some examples, the processor is configured to generate a first intensity curve, using the detected first detection values, that is representative of the first analyte in the sample, wherein the processor is further configured to generate a second intensity curve, using the detected second detection values, that is representative of the second analyte in the sample.

In other examples, the processor is configured to use a curve shape from a pre-scan first analyte curve to generate the first intensity curve, and wherein the processor is configured to use a curve shape from a pre-scan second analyte curve to generate the second intensity curve.

In certain examples, the processor is configured to use peak height of the first intensity curve to determine an amount of the first analyte in the transient sample, and wherein the processor is configured to use peak height of the second intensity curve to determine an amount of the second analyte in the transient sample.

In some examples, the processor is configured to use peak area of the first intensity curve to determine an amount of the first analyte in the transient sample, and wherein the processor is configured to use peak area of the second intensity curve to determine an amount of the second analyte in the transient sample.

In certain embodiments, the collision-reaction cell comprises two or more axial electrodes configured to provide an axial field within the collision-reaction cell to further broaden the ion cloud in the collision-reaction cell.

In other instances, the system is configured to alter a sampling depth to broaden the ion cloud generated by the ionization source.

In some examples, the ionization source is configured as an inductively coupled plasma.

In other examples, the system comprises an ion deflector positioned between the interface and the collision-reaction cell.

In some examples, the system comprises ion optics between the collision-reaction cell and the mass analyzer.

In an additional aspect, a mass spectrometer system configured to quantify an amount of a first analyte and an amount of a second analyte in a transient sample is described.

In some examples, the system comprises an ionization source configured to generate an ion cloud comprising ions from the first analyte and ions from the second analyte. In some instances, the system comprises an interface fluidically coupled to the ionization source, the interface configured to sample the generated ion cloud. In other instances, the system comprises a collision-reaction cell fluidically coupled to the interface and configured to receive the sampled, generated ion cloud, wherein the collision-reaction cell comprises two or more axial electrodes configured to provide an axial field to broaden the sampled, generated ion cloud in the collision-reaction cell. In some examples, the system comprises a mass analyzer fluidically coupled to the collision-reaction cell and configured to receive the broadened ion cloud from the collision-reaction cell, the mass analyzer configured to alternately select ions from the first analyte and the ions from the second analyte. In certain examples, the system comprise a detector configured to receive the alternately selected ions from the mass analyzer and detected received ions from the first analyte as first detection values during a detection period and to detect received provided ions from the second analyte as second detection values during the detection period. In some examples, the system comprises a processor configured determine an amount of the first analyte in the transient sample using the first detection values and configured to determine an amount of the second analyte in the transient sample using the second detection values.

In certain examples, the processor is configured to generate a first intensity curve, using the detected first detection values, that is representative of the first analyte in the sample, wherein the processor is further configured to generate a second intensity curve, using the detected second detection values, that is representative of the second analyte in the sample.

In other examples, the processor is configured to use a curve shape from a pre-scan first analyte curve to generate the first intensity curve, and wherein the processor is configured to use a curve shape from a pre-scan second analyte curve to generate the second intensity curve.

In some examples, the processor is configured to use peak height of the first intensity curve to determine an amount of the first analyte in the transient sample, and wherein the processor is configured to use peak height of the second intensity curve to determine an amount of the second analyte in the transient sample.

In other examples, the processor is configured to use peak area of the first intensity curve to determine an amount of the first analyte in the transient sample, and wherein the processor is configured to use peak area of the second intensity curve to determine an amount of the second analyte in the transient sample.

In some embodiments, the collision-reaction cell comprises a quadrupolar rod set and is configured to receive a gas to pressurize the collision-reaction cell to further broaden the ion cloud in the collision-reaction cell.

In certain embodiments, the system is configured to alter a sampling depth to broaden the ion cloud generated by the ionization source.

In other embodiments, the ionization source is configured as an inductively coupled plasma.

In some embodiments, the system comprises an ion deflector positioned between the interface and the collision-reaction cell.

In other embodiments, the system comprises ion optics between the collision-reaction cell and the mass analyzer.

In another aspect, a mass spectrometer system configured to quantify an amount of a first analyte and an amount of a second analyte in a transient sample is provided. In some examples, the system comprises an ionization source configured to generate an ion cloud comprising ions from the first analyte and ions from the second analyte. In other examples, the system comprises an interface fluidically coupled to the ionization source, the interface configured to sample the generated ion cloud and broaden the sampled ion cloud by adjusting a sampling depth between the interface and an ionization region of the ionization source. In some examples, the system comprises a mass analyzer fluidically coupled to the interface and configured to receive the broadened ion cloud from the interface, the mass analyzer configured to alternately select ions from the first analyte and the ions from the second analyte. In some embodiments, the system comprises a detector configured to receive the alternately selected ions from the mass analyzer and detected received ions from the first analyte as first detection values during a detection period and to detect received provided ions from the second analyte as second detection values during the detection period. In certain examples, the system comprises a processor configured determine an amount of the first analyte in the transient sample using the first detection values and configured to determine an amount of the second analyte in the transient sample using the second detection values.

In certain examples, the processor is configured to generate a first intensity curve, using the detected first detection values, that is representative of the first analyte in the sample, wherein the processor is further configured to generate a second intensity curve, using the detected second detection values, that is representative of the second analyte in the sample.

In other examples, the processor is configured to use a curve shape from a pre-scan first analyte curve to generate the first intensity curve, and wherein the processor is configured to use a curve shape from a pre-scan second analyte curve to generate the second intensity curve.

In some examples, the processor is configured to use peak height of the first intensity curve to determine an amount of the first analyte in the transient sample, and wherein the processor is configured to use peak height of the second intensity curve to determine an amount of the second analyte in the transient sample.

In certain examples, the processor is configured to use peak area of the first intensity curve to determine an amount of the first analyte in the transient sample, and wherein the processor is configured to use peak area of the second intensity curve to determine an amount of the second analyte in the transient sample.

In some examples, the system comprises a collision-reaction cell positioned between the interface and the mass analyzer, wherein the collision-reaction cell comprises a quadrupolar rod set and is configured to receive a gas to pressurize the collision-reaction cell to further broaden the sampled ion cloud.

In other examples, the collision-reaction cell comprises two or more axial electrodes configured to provide an axial field to further broaden the sampled ion cloud.

In some embodiments, the ionization source is configured as an inductively coupled plasma.

In certain examples, the system comprises an ion deflector positioned between the interface and the mass analyzer.

In other examples, the system comprises ion optics between the ion deflector and the mass analyzer.

In another aspect, a mass spectrometer configured to correct for data gaps during alternate detection of a first inorganic analyte and a second inorganic analyte to permit quantitation of each of a first analyte and a second analyte in a transient sample is described. In certain configurations, the mass spectrometer comprises a processor configured to receive alternately detected detection values detected during a broadened detection interval. The alternately detected detection values comprise first detection values from detected ions from ionized first analyte and second detection values from detected ions from ionized second analyte. During the broadened detection interval the mass spectrometer is configured to provide a number of non-zero detection values detected for each of the ionized first inorganic analyte and the ionized second inorganic analyte that is greater when compared to a number of non-zero detection values detectable for each of the ionized first analyte and the ionized second analyte within a non-broadened detection interval. The processor is configured to use the received first detection values and the received second detection values to determine an amount of each of the first analyte and the second analyte present in the transient sample.

In certain examples, the processor is configured to generate a first intensity curve, using the detected first detection values, that is representative of the first analyte in the sample, wherein the processor is further configured to generate a second intensity curve, using the detected second detection values, that is representative of the second analyte in the sample.

In other examples, the processor is configured to use a curve shape from a pre-scan first analyte curve to generate the first intensity curve, and wherein the processor is configured to use a curve shape from a pre-scan second analyte curve to generate the second intensity curve.

In some examples, the processor is configured to use peak height of the first intensity curve to determine an amount of the first analyte in the transient sample, and wherein the processor is configured to use peak height of the second intensity curve to determine an amount of the second analyte in the transient sample.

In additional examples, the processor is configured to use peak area of the first intensity curve to determine an amount of the first analyte in the transient sample, and wherein the processor is configured to use peak area of the second intensity curve to determine an amount of the second analyte in the transient sample.

In some embodiments, the mass spectrometer comprises a collision-reaction cell positioned between an interface and a mass analyzer, wherein the collision-reaction cell comprises a quadrupolar rod set and is configured to receive a gas to pressurize the collision-reaction cell to further broaden an ion cloud in the collision-reaction cell.

In other embodiments, the collision-reaction cell comprises two or more axial electrodes configured to provide an axial field to further broaden the ion cloud in the collision-reaction cell.

In additional examples, the system comprises an ionization source positioned upstream of the interface, wherein the ionization source is configured as an inductively coupled plasma.

In other examples, the interface is adjustable to alter a sampling depth.

In some examples, the system comprises an ion deflector positioned between the interface and the mass analyzer and ion optics between the ion deflector and the mass analyzer.

In an additional aspect, a mass spectrometer configured to operate in a single analyte mode and in a dual analyte mode is provided. The single analyte mode can be configured to detect a first analyte over a detection period, and the dual analyte mode can be configured to detect the first analyte and a second analyte over the detection period. The mass spectrometer comprises a collision-reaction cell configured to receive a gas to pressurize the collision-reaction cell and broaden an ion cloud introduced into the collision-reaction cell to provide more non-zero detection values than a number of non-zero detection values detected when the ion cloud introduced into the collision-reaction cell is not broadened.

In another aspect, a mass spectrometer configured to operate in a single analyte mode and in a dual analyte mode is provided. The single analyte mode can be configured to detect a first analyte over a detection period, and the dual analyte mode can be configured to detect the first analyte and a second analyte over the detection period. The mass spectrometer comprises a collision-reaction cell comprising axial electrodes configured to provide an axial field. The axial field can be configured to be altered to broaden an ion cloud introduced into the collision-reaction cell to provide more non-zero detection values than a number of non-zero detection values detected when the ion cloud introduced into the collision-reaction cell is not broadened using the axial field.

In an additional aspect, a mass spectrometer configured to operate in a single analyte mode and in a dual analyte mode is disclosed. The single analyte mode can be configured to detect a first analyte over a detection period, and the dual analyte mode can be configured to detect the first analyte and a second analyte over the detection period. The mass spectrometer comprises an interface configured to broaden an ion cloud by altering a sampling depth between the interface and an ionization source, wherein the broadened ion cloud provides more non-zero detection values than a number of non-zero detection values detected when the ion cloud introduced into the mass spectrometer is not broadened.

In another aspect, a method of quantifying two or more analytes in a single colloid using a mass spectrometer is described. The method comprises alternately measuring detection values using the mass spectrometer, wherein the measured detection values are representative of ions from a first analyte in the single colloid and ions from a second analyte in the single colloid, wherein the detection values representative of ions from the first analyte are measured as first detection values and wherein the detection values representative of ions from the second analyte are measured as second detection values. The method comprises generating a first intensity curve using the first detection values and generating a second intensity curve using the second detection values. The method comprises using the generated first intensity curve to determine an amount of the first analyte present in the colloid and using the generated second intensity curve to determine an amount of the second analyte present in the colloid.

Additional aspects, examples, embodiments and configurations are described in more detail below.

BRIEF DESCRIPTION OF THE SEVERAL VIEWS OF THE DRAWINGS

Certain aspects, embodiments and configurations are described below with reference to the accompanying figures in which.

DETAILED DESCRIPTION

Figure 1:
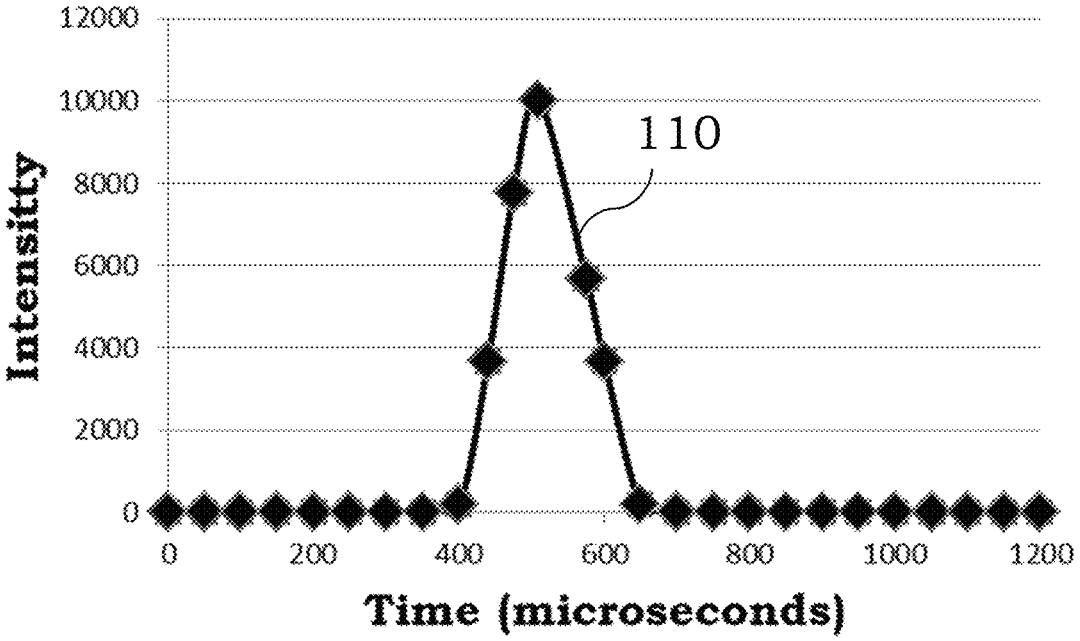
FIG. 1 is a graph showing a data values in a single analyte mode of a mass spectrometer, in accordance with certain configurations.

In certain configurations, the methods and systems described herein can be designed to increase the duration of a transient event, e.g., from a typical 400 microsecond event to more than 1 millisecond event, so that more data points per analyte ion can be obtained in the case of interleaving data acquisition. For example, a single system can be introduced into a mass spectrometer and the amounts of one, two, three or more analytes present in the single system can be quantified. As used herein, the phrase "single system" generally refers to a single nanoparticle, single nanostructure, single cell, single organelle of a cell or a single colloid molecule which comprises one, two, three or more analytes either covalently or ionically bonded to other constituents of the molecule or otherwise interacting by way of local forces, e.g., hydrostatic, van der Waals' forces, etc. with the other constituents of the molecule. As noted herein, the analytes of interest tend to be inorganic elemental analytes such as alkali metals, alkaline earth metals, transition metals, actinides, lanthanides, metalloids or other elements that can form positive ions when ionized. In some instances, the methods and systems described herein may be particularly desirable for use in quantifying one or more analytes including, but not limited to, Li, Be, B, Na, Mg, Al, Si, P, S, Cl, Ar, K, Ca, Sc, Ti, V, Cr, Mn, Fe, Co, Ni, Cu, Zn, Ga, Ge, As, Se, Br, Kr, Rb, Sr, Y, Zr, Nb, Mo, Tc, Ru, Rh, Pd, Ag, Cd, In, Sn, Sb, Te, I, Xe, Cs, Ba, La, Hf, Ta, W, Re, Os, Jr, Pt, Au, Hg, Tl, Pb, Bi, Ce, Pr, Nd, Sm, Eu, Gd, Tb, Dy, Ho, Er, Tm, Yb, Lu, Th, Pa, and U present in the single system. In other examples, the transient samples provided by the single systems described herein may comprise two or more of Li, Be, B, Na, Mg, Al, Si, P, S, Cl, Ar, K, Ca, Sc, Ti, V, Cr, Mn, Fe, Co, Ni, Cu, Zn, Ga, Ge, As, Se, Br, Kr, Rb, Sr, Y, Zr, Nb, Mo, Tc, Ru, Rh, Pd, Ag, Cd, In, Sn, Sb, Te, I, Xe, Cs, Ba, La, Hf, Ta, W, Re, Os, Ir, Pt, Au, Hg, Tl, Pb, Bi, Ce, Pr, Nd, Sm, Eu, Gd, Tb, Dy, Ho, Er, Tm, Yb, Lu, Th, Pa, and U. In additional examples, the transient samples provided by the single systems described herein may comprise two or more of Li, Be, B, Na, Mg, Al, Si, P, S, Cl, Ar, K, Ca, Sc, Ti, V, Cr, Mn, Fe, Co, Ni, Cu, Zn, Ga, Ge, As, Se, Br, Kr, Rb, Sr, Y, Zr, Nb, Mo, Tc, Ru, Rh, Pd, Ag, Cd, In, Sn, Sb, Te, I, Xe, Cs, Ba, La, Hf, Ta, W, Re, Os, Ir, Pt, Au, Hg, Tl, Pb, Bi, Ce, Pr, Nd, Sm, Eu, Gd, Tb, Dy, Ho, Er, Tm, Yb, Lu, Th, Pa, and U. In a typical configuration, the single system is generally homogenous such that all sampled single systems, e.g., nanoparticles, nanostructures, etc., generally have the same composition. While some embodiments are described below in connection with single nanoparticles, single nanosystems, single cells and the like, the method and systems can also be used in analyzing multiple analytes for other transient events such as analytes in the plume of solid sample formed by laser ablation or a vapor plug formed by electrothermal vaporization.

In certain examples, to determine accurately the amount of each of the analytes present in the single system, the shape of the events in a single analyte mode can be used for each analyte ion of interest to construct or generate a peak shape that can be used to fill in missing data gaps. The phrase "single analyte mode" refers to using a mass spectrometer to measure a single analyte over a detection period. For example, a voltage of a mass analyzer can be selected such that only a single inorganic analyte is provided to a detector for detection. In a "dual analyte mode," the mass spectrometer may switch between two voltages to select a first analyte at a voltage V1, which can be detected by the detector, and then switch to a second voltage V2 to select a second analyte, which can be detected by the detector. The peak shape obtained in the single analyte mode can be used to reconstruct the missing detection values or data points which are not detected when the mass spectrometer is operated in the dual analyte mode with reasonable accuracy. Once each event is reconstructed, an intensity of the event and/or peak area, which is related to the amount of that analyte in that nanoparticle, nanosystem, etc. can be determined.

In certain embodiments, to determine the shape of the curve in the single analyte mode, curve fitting can be performed using numerous different techniques such as, for example, by minimizing the sum of squared errors or similar a technique to obtain the best scaling factor and position for the average peak shape. Data points of the fitted average peak simulate the complete event, and the peak area is an estimation of the event area intensity, and the peak height is an estimation of the height of the event. The fitted curve could be of Gaussian type or a modified Gaussian type to account for the tailing and the asymmetry where a broadened ion cloud is used.

In some embodiments, the transient event may be representative of one or more analyte species in a single system such as, for example, a nanoparticle, nanostructure, microparticle microstructure, single cell, a single sub-cellular structure such as, for example, a cellular organelle or other single systems. Single-particle (SP) ICP-MS can be used to detect metal-containing nanoparticles at very low levels with great precision and accuracy. The detection of such nanoparticles is important in a variety of fields, particularly environmental health. For example, while there is great interest in the use of engineered nanomaterials in a wide variety of industrial and commercial applications, such nanoparticles may be harmful to humans. At the nanoscale, particles can be more chemically reactive and bioactive, allowing them to more easily penetrate organs and cells.

In single particle mode analysis (SP-ICP-MS), a dilute solution of a dissolved metal will produce a relatively constant signal, while signals from solid nanoparticles that are suspended in the solution can be detected as single-point pulses or multi-point peaks whose intensity exceeds the background signal from the dissolved metal. SP-ICP-MS permits the differentiation between signals produced by dissolved analyte and signals produced by solid nanoparticle analyte. In order for SP-ICP-MS to work at low nanoparticle concentrations, the speed of data acquisition and the response time of the ICP-MS quadrupole and detector must be fast enough to capture the pulses/peaks corresponding to the nanoparticles. Sequences of pulses/peaks can be identified and quantified by an instrument running with a short enough dwell time (e.g., a few milliseconds or shorter) to resolve the individual nanoparticle pulses/peaks in the time domain. For example, the NexION® 300 ICP-MS, manufactured by PerkinElmer Health Sciences, Inc. of Shelton, Conn., can be operated in Single Particle mode with a high-speed data acquisition system capable of integrating ionic signals at a dwell time of 10 microseconds without any settling time in between. Peak height or area under a peak can be compared to calibration curves to determine the concentration of the particles in the sample and the mass and size distribution of the particles in the sample. Coupled with a size-separation technique, e.g., field flow fractionation (FFF) and liquid chromatography (LC), SP-ICP-MS is capable of addressing size, size distribution, surface charge, and surface functionality of nanoparticles in samples.

Figure 2:
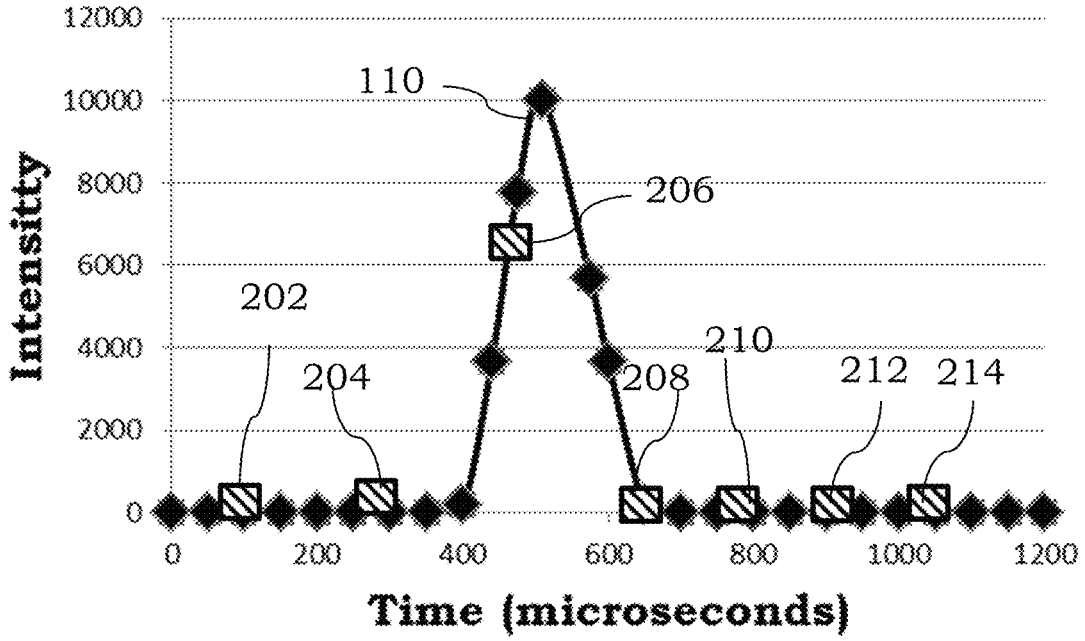
FIG. 2 is a graph in a dual analyte mode of a mass spectrometer, in accordance with certain configurations.

SP-ICP-MS is typically performed to measure a single elemental species in the nanoparticle. Where two or more elemental species are present in a single nanoparticle, detection of both elemental species in a transient event produced from ionization of the single nanoparticle is difficult. Due to the time delay/settling of various components in the MS system and due to ion flight times, which in total can often take 200 microseconds to switch between detection of two different analytes, the amount of data that can be obtained for such short-lived transient events when switching between the two analytes is not sufficient for quantitation purposes. A simple illustration comparing a single analyte mode (e.g., detecting only one analyte in the nanoparticle or single system) with a dual analyte mode (e.g., detecting two analytes in the nanoparticle or single system) is shown graphically in FIGS. 1 and 2. Referring to FIG. 1, data points obtained in a single analyte mode over time are shown. A sufficient amount of non-zero data values, e.g., seven non-zero data points in this example, can be collected to generate a curve 110 representative of the single analyte in the nanoparticle. The peak height or area under the generated curve 110 can be used to determine an amount of the single analyte present in the nanoparticle, or single system e.g., by comparing the determined area under the curve 110 to a calibration curve. When the MS instrument is in a dual analyte mode, the different analytes present in an ion cloud must be individually selected using a mass analyzer. There is a time delay as the mass analyzer switches from a voltage V1 to a voltage V2 to select the second analyte rather than the first analyte. As the mass analyzer switches back and forth between V1 and V2, it is possible to detect signals representative of each of the first analyte and the second analyte in the nanoparticle or single system. FIG. 2 shows representative data that would be detected for the first analyte when the MS is in a dual analyte mode. The representative data has been superimposed onto the curve 110 of FIG. 1 for illustration purposes. Detection values 202, 204, 206, 208, 210, 212 and 214 for the single analyte are shown in FIG. 2 when the mass spectrometer is in the dual analyte mode. Due to the switching between filtering/scanning and detection of the two analytes present in the single nanoparticle or single system, only a single non-zero value (206) is detected when the MS is in the dual analyte mode. A certain amount of the first analyte ions are not detected at all, since the MS is set up at certain times to scan and detect for the second analyte. If a curve was fit or generated using the values 202-214, then the area under that curve (or peak height) would be significantly different from the area under the curve 110. The reduced amount of non-zero detection values that can be obtained in the dual analyte mode would lead to an incorrect determination of the amount of the first analyte being present in the nanoparticle or single system than is actually present in the nanoparticle or single system.

In certain configurations, in order to overcome the inaccuracies which are produced from missing data when two or more analytes in a single system are alternately detected, a duration of the transient event can be increased to permit detection of additional non-zero data values. While the exact method used to increase the duration of the transient event may vary (as noted in more detail below), the methodology used generally results in broadening of the ion cloud to increase the overall event duration. Broadening of the ion cloud results in an overall increase in even duration, e.g., from 100-400 microseconds at full width half maximum to 1-2 milliseconds or more at full width half maximum, which can permit detection of additional non-zero detection values for each of two or more analytes present in a single system (such as a single nanoparticle or a single nanostructure) with higher accuracy and precision. To broaden the ion cloud, the ion velocities of different ions in the cloud can be differentially altered. This process can result in increased spatial separation of ions in the cloud, e.g., spreading out of the ions, which acts to increase the overall time of the transient event. An increase in transient event time provides for more time to detect additional non-zero detection values for one, two or more analytes present in the ion cloud produced from the transient sample.

Figure 3:
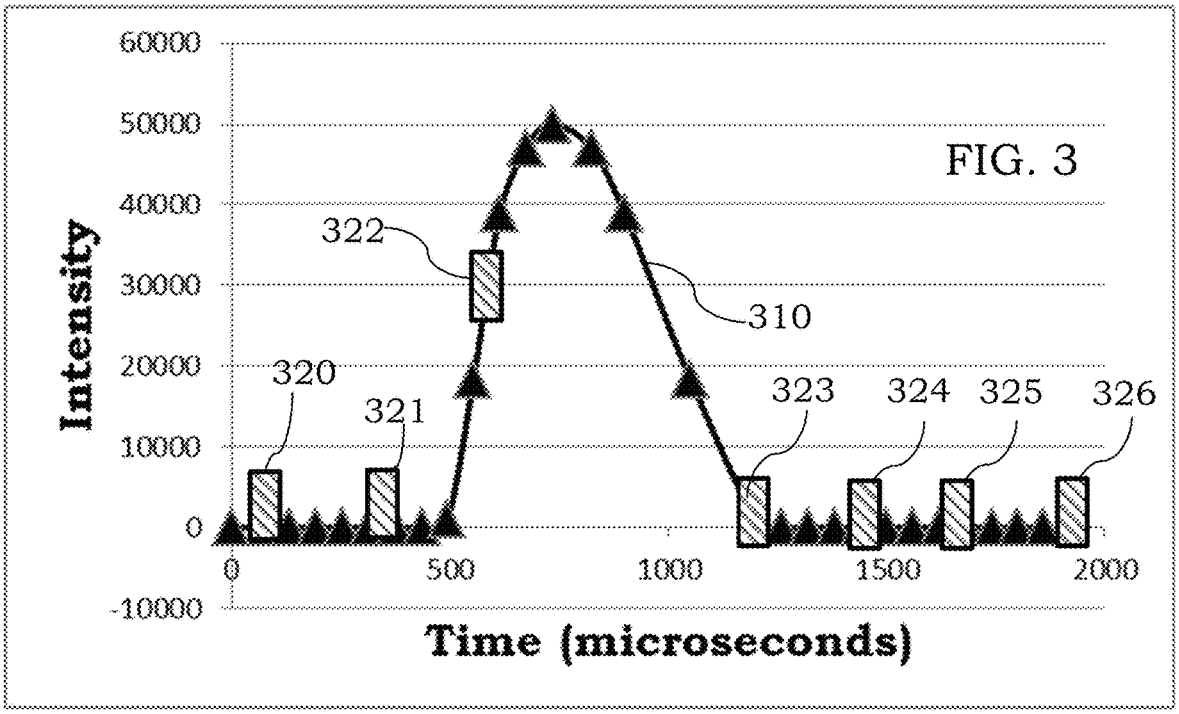
FIG. 3 is a graph showing a data values in a single analyte mode of a mass spectrometer, in accordance with certain configurations.
Figure 4:
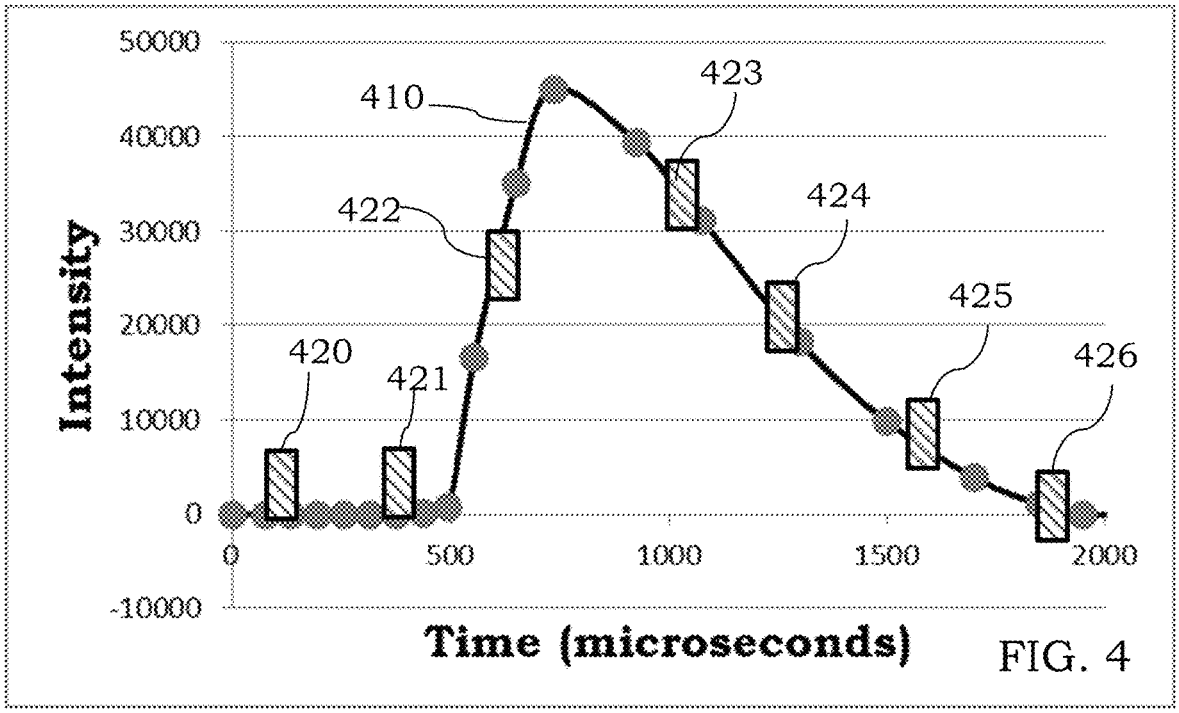
FIG. 4 is a graph in a single analyte mode and in a dual analyte mode of a mass spectrometer where an event duration has been increased, in accordance with certain configurations.

In certain examples, another illustration is shown graphically in FIGS. 3 and 4 to illustrate broadening of the ion cloud to provide an overall increase in event duration. Referring to FIG. 3, a graph is shown where the ion cloud has not been broadened in both a single analyte mode (resulting in curve 310) and a dual analyte mode (data values 320-326). In the single analyte mode, a plurality of detection values, including eight non-zero detection values, are obtained and used to construct the curve 310. As can be seen in FIG. 3, only a single non-zero detection value (detection value 322) is obtained in the dual analyte mode when the ion cloud is not broadened.

Referring now to FIG. 4, for the single analyte mode, more non-zero detection values are obtained using the broadened ion cloud. These additional values can be used to provide a better representation of the analyte and to generate a more accurate curve 410. In addition, the curve 410 tails off or is similar to a skewed Gaussian curve, which indicates that the ion cloud has been broadened. In the dual analyte mode (rectangular data points in FIG. 4) and where the ion cloud has been broadened, more non-zero detection values (detection values 422-425 in detection values 420-426 for the analyte) are obtained compared to the single non-zero detection value (value 322) obtained when the ion cloud was not broadened. The increased number of non-zero detection values obtained by broadening the ion cloud can provide a more accurate representation of the analyte curve. In addition, broadening the ion cloud permits detection of two, three or more analytes of interest in the same transient event, e.g., two, three or more different analytes of interest in the same single system such as a single nanoparticle or single nanostructure can be detected with high accuracy. This broadening may be particularly desirable where two, three or more different inorganic elements are present in a single system such as, for example, a single nanoparticle, a single nanostructure, a single microparticle or a single microstructure. The broadening of the ion cloud permits an accurate determination of the amount of different analytes present in the single system in a rapid and efficient manner.

In certain embodiments, several methods can be used to increase a duration of a transient event. These methods include, but are not limited to, pressurizing a collision-reaction cell, altering axial field strength within a collision-reaction cell and adjusting sampling depth, e.g., the distance between a sampling interface and a front end of an ionization region of an ionization source such as a plasma. As noted in more detail below, these methods can be used alone or in combination with each other to increase a duration of a transient event.

Figure 5:
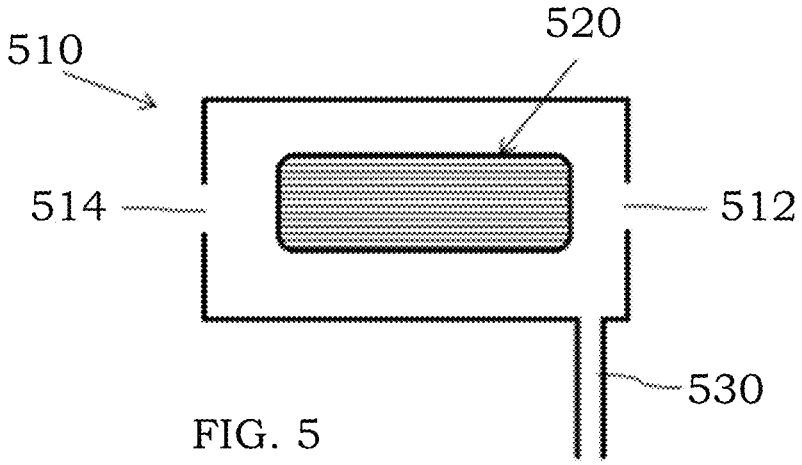
FIG. 5 is an illustration of a collision-reaction cell, in accordance with certain examples.
Figure 6:
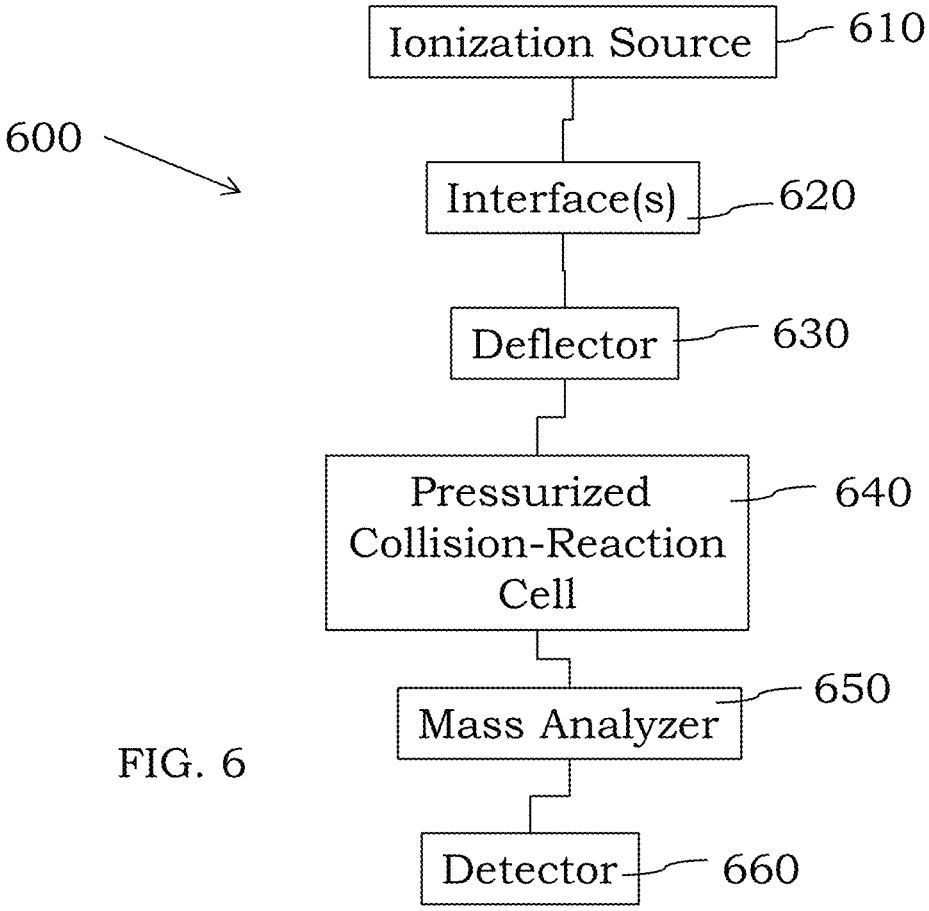
FIG. 6 is a block diagram showing certain components of a mass spectrometry system, in accordance with certain examples.

In certain embodiments, a collision-reaction cell can be pressurized to broaden an ion cloud within the collision-reaction cell. One illustration of a collision-reaction cell is shown in FIG. 5. The collision-reaction cell 510 comprises an inlet end 512, an outlet end 514, a rod set 520 and a gas inlet 530. The gas inlet 530 is typically fluidically coupled to a gas source which can be used to pressurize the cell 500. If desired, the gas inlet 530 may be the only gas inlet present for the cell 500. The gas inlet 530 can be used to provide a gas into the cell to pressurize the cell and broaden the ion cloud. In a typical configuration, the cell 510 may be one component in a MS system which comprises a plurality of other components. For example and referring to FIG. 6, a MS system 600 may comprise an ionization source 610, one or more interfaces 620, a deflector 630, a collision-reaction cell 640, a mass analyzer 650 and a detector 660. While not shown, a sample introduction device, e.g., a nebulizer, injector, etc., may also be present and used to introduce a sample into the ionization source 610. While the exact ionization source 610 can vary and numerous types are mentioned below, the ionization source 610 typically ionizes analytes within the single system. The ionization source 610, for example, can vaporize the elemental species present in a single nanoparticle or single nanosystem in a plasma torch to generate analyte ions. Upon exiting the ionization source 610, the analyte ions can be extracted using the interface 620, e.g., one that may comprise a sampler plate and/or skimmer (as noted in more detail below). The ion extraction provided by the interface 620 can result in a narrow and highly focused ion beam that can be provided to one or more downstream components of the system 600. The interface 620 is typically present in a vacuum chamber evacuated by one or more pumps to an atmospheric pressure of about 3 Torr. A more detailed description of an interface is described below. If desired, the interface 620 may comprise multiple different stages or chambers to enhance ion extraction further.

In certain configurations, as the analyte ions exit the interface 620 they can be provided to the deflector 630. The deflector 630 is typically operative to select analyte ions entering into the deflector 630 and provide them to a downstream component. For example, the ion deflector 630 can be configured as a quadrupole ion deflector, comprising a quadrupole rod set whose longitudinal axis extends in a direction that is approximately orthogonal to entrance and exit trajectories of the ion beam. The quadrupole rods in the deflector 630 can be provided with suitable voltages from a power supply to provide a deflection field in the ion deflector quadrupole. Because of the configuration of the quadrupole rods and the applied voltages, the resulting deflection field can be effective at deflecting charged particles in the entering ion beam through an approximately 90 degree angle (or other selected angles). The exit trajectory of the ion beam can thus be roughly orthogonal to the entrance trajectory (as well as to the longitudinal axis of the quadrupole). If desired, however, the deflector or guide can be configured differently as described for example in U.S. Patent Publication Nos. 20170011900 and 20140117248. The ion deflector 630 can selectively deflect the various ion populations in the ion beam (both analyte and interfering ions) through to the exit, while other neutrally charged, non-spectral interferences are discriminated against. For example, the deflector 630 can selectively remove light photons, neutral particles (such as neutrons or other neutral atoms or molecules), as well as other gas molecules from the ion beam, which have little or no appreciable interaction with the deflection field formed in the multipole on account of their neutral charge. The deflector 630 can be included in the mass spectrometer system 600 as one possible means of eliminating non-spectral interferers from the ion beam, though other means can also be used.

In certain configurations, the ion beam once exiting the deflector 630 along the exit trajectory can be transmitted to an entrance end (e.g., end 512 of the cell 510 in FIG. 5) of the pressurized collision-reaction cell 640. As described in more detail below, an entrance member or lens can be present in the cell 640 or adjacent to the cell 640. The entry member or lens can provide an ion inlet for receiving the ion beam into the pressurized collision-reaction cell 640. If the deflector 630 is omitted from the mass spectrometer system 600, the ion beam may be transmitted directly from either the interface 620 to the cell 640 through the entrance member or lens. At an exit end (e.g., end 514 of the cell 510 in FIG. 5) of the pressurized cell 640 may be a suitable exit member, such as an exit lens. The exit lens may provide an aperture through which ions traversing the pressurized cell 640 may be ejected to downstream analytical components of the mass spectrometer system 600 such as a mass analyzer 650 and a detector 660.

Figure 7A:
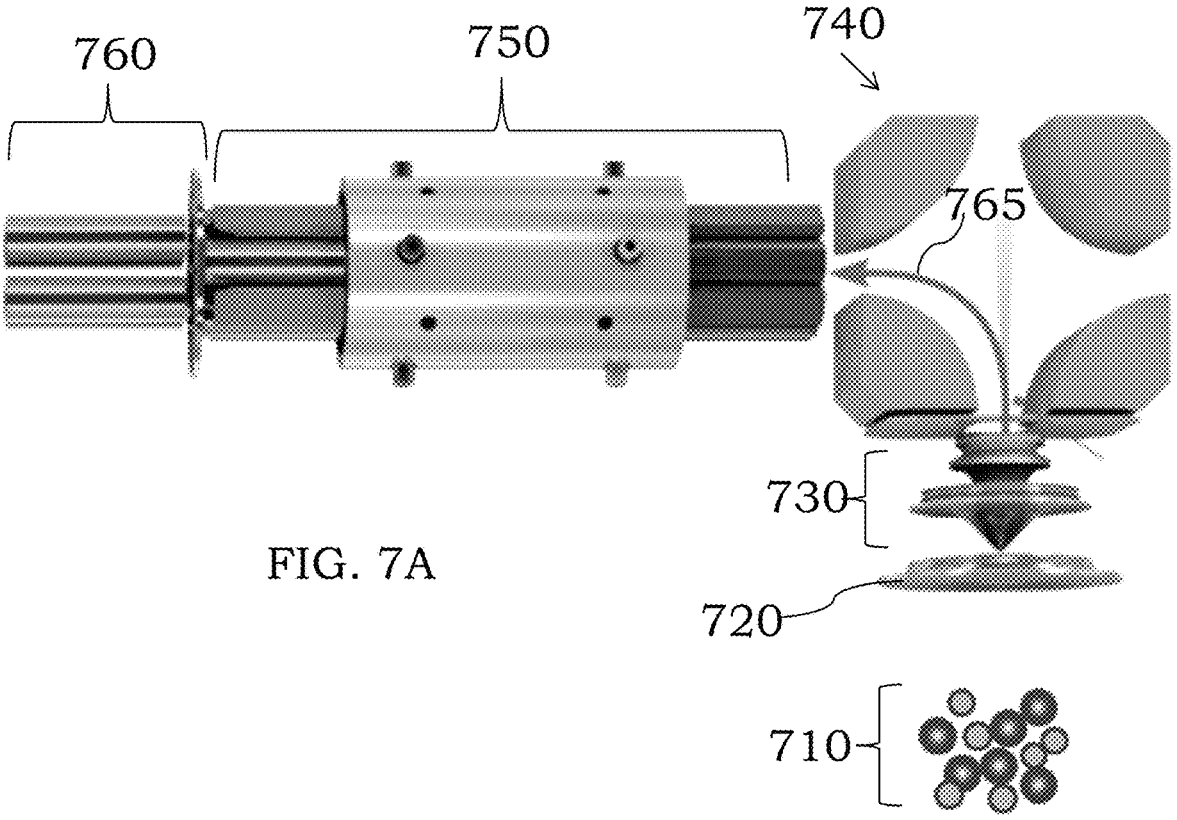
FIGS. 7A, 7B and 7C are illustrations showing movement of two analyte ions through a portion of a mass spectrometry system, in accordance with certain configurations.
Figure 7B:
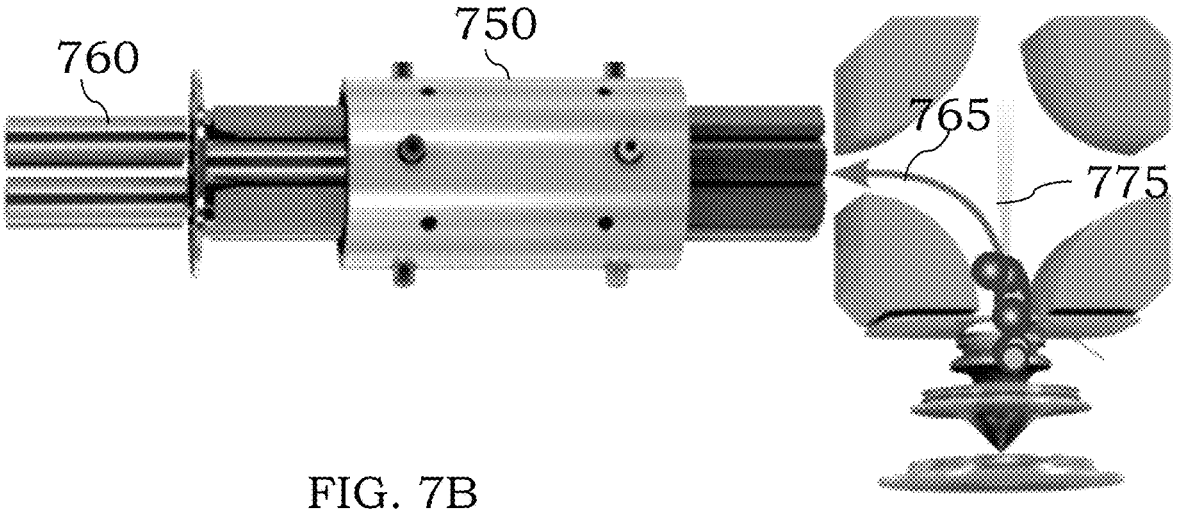
Figure 7C:
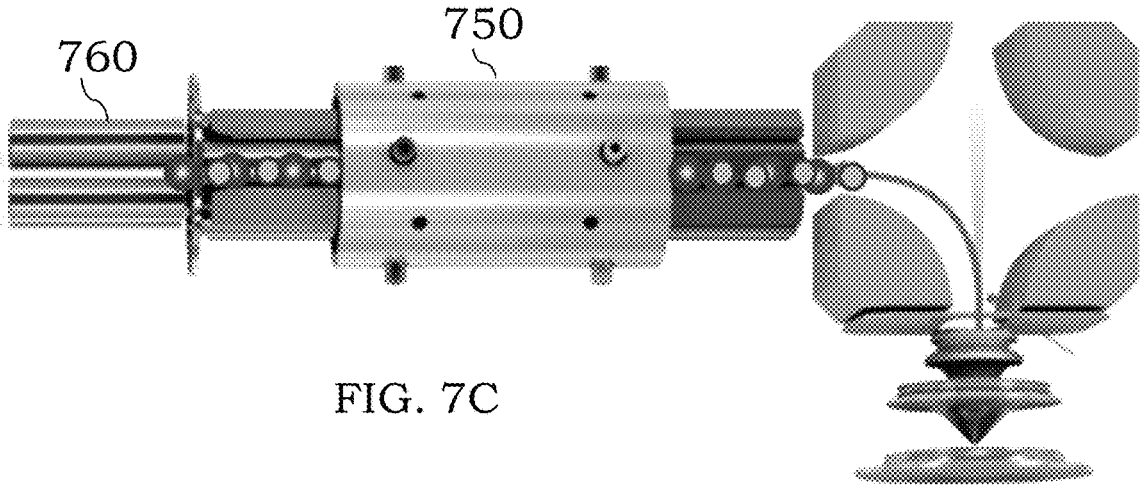

In certain configurations, a gas or gas mixture can be introduced into the pressurized collision-reaction cell 640 to pressurize the cell and differentially broaden the ion cloud within the cell 640 to increase a duration of a transient event. An illustration of this broadening is shown schematically in FIGS. 7A-7C. For illustration purposes the pressurized cell of FIGS. 7A-7C is configured with a quadrupole rod set, though other rod set configurations could be used instead. Referring to FIG. 7A, an ion cloud 710 comprising a plurality of ions comprising first analyte ions and second analyte ions (different from the first analyte ions) is shown as being upstream of a sampling interface 720 and skimmer cones 730. While not shown, the ion cloud 710 typically exit an ionization source that is positioned upstream of the sampling interface 720. A deflector 740 is shown positioned between the skimmer cones 730 and a pressurized collision-reaction cell 750. Ion optics 760 are shown positioned downstream of the pressurized cell 750. Referring to FIG. 7B, as the ions 710 enter the interfaces 720, 730, they are provided to the deflector 740, which is configured to deflect the ions at an orthogonal angle along a trajectory 765 to the entrance of the deflector 740 and provide the ions to the pressurized cell 750. Deflection of the ions by the deflector 740 can act to remove interfering species as the interfering species generally continue along the trajectory 775 within the deflector 740. Referring to FIG. 7C, as the ion cloud enters the pressurized cell 750, the ions spread out and align along the rods of the cell 750. Different ions interact differently with the gas molecules introduced into the pressurized cell, which causes an overall broadening of the ion cloud within the cell 750. Without wishing to be bound by this particular illustration, this broadening can occur as a result of alteration of ion velocities by the pressurized cell. For example, different first analyte ions can adopt different ion velocities by interacting with gas molecules in the cell 750 to broaden the ion cloud. Similarly, different second analyte ions can adopt different ion velocities by interacting with gas molecules in the cell 750 to broaden the ion cloud. The resulting broadened ion cloud comprises first and second analyte ions which are more spatially separated or spread out as compared to an ion cloud provided using the collision-reaction cell in a non-pressurized state. As a result of the broadened ion cloud, as the analyte ions are provided through the ion optics 760 and to a downstream mass filter and detector (not shown), the overall duration of the event is increased, which permits detection of additional non-zero data values representative of the first analyte ions and the second analyte ions. As noted herein, these detected non-zero data values can be used to generate an intensity curve for each of the detected first analyte ions and the detected second analyte ions. The generated intensity curves can be compared to calibration curves for each of the first analyte and the second analyte to accurately determine an amount of each of the first analyte and the second analyte in the single system.

In certain configurations, the pressurized collision-reaction cell can be configured as a multipole pressurized cell, e.g., one including 2, 4, 6, 8 or 10 rods. For example, the collision-reaction cell can be configured as a quadrupole pressurized cell enclosing a quadrupole rod set within its interior space. As is conventional, the quadrupole rod set can comprise four cylindrical rods arranged evenly about a common longitudinal axis that is collinear with the path of the incoming ion beam. The quadrupole rod set can be electrically coupled to a voltage source to receive an RF voltage therefrom suitable for creating a quadrupolar field within the quadrupole rod set. For example, the field formed in the quadrupolar rod set can provide radial confinement for ions being transmitted along its length from the entrance end toward the exit end of the pressurized collision-reaction cell. As illustrated better in FIGS. 8A and 8B, diagonally opposite rods in the quadrupole rod sets 840*a*, 840*b* can be coupled together to receive out-of-phase RF voltages, respectively, from the voltage source 842. A DC bias voltage may also, in some instances, be provided to the quadrupole rod sets 840*a*, 840*b*. Voltage source 842 can also provide a cell offset (DC bias) voltage to the collision-reaction cell. While the exact voltage provided to the quadrupole rod sets may vary, illustrative voltages include, but are not limited to, about +500 Volts to about +50 Volts (peak-to-peak voltage) with voltages in the range of about +250 Volts to about +50 Volts being used in a typical scenario where two analytes present in a single system are being quantified. It will be recognized by the skilled person in the art, given the benefit of this disclosure, that the exact voltages used may vary and may depend, at least in part, on the analyte ions to be quantified and/or the voltage frequency used.

In certain examples, the exact pressures used to broaden the ion cloud may vary depending on the analyte ions and other ions present in the ion cloud. In some examples, the cell can be pressurized to about 1 milliTorr to about 100 milliTorr. For example, the cell can be pressurized to about 5 milliTorr to about 50 milliTorr, e.g., to 10, 20, 30 or 40 milliTorr, by introducing a suitable gas or gas mixture into the cell. The exact gas introduced into the cell may vary and suitable gases are generally those that can differentially interact with ions in the pressurized cell to broaden the ion cloud. Gases with heavy molecules may be more desirable for broadening the ion cloud. For example, suitable gases include, but are not limited to, He, Ne, Ar, Kr, Xe, $N_2$, $CO_2$, $CH_4$, $C_2H_6$, $C_3H_8$, $CH_3F$, $CH_3Cl$, $N_2O$, $NO_2$, NO, $O_2$, $NH_3$, and $SF_6$.

In some examples, the quadrupole rod sets 840*a*, 840*b* can be aligned collinearly with the entry lens and exit lens (not shown) along its longitudinal axis, thereby providing a complete transverse path through the pressurized collision-reaction cell for ions in the ion beam. In some examples, the entry lens may also be sized appropriately (e.g. 4.2 mm) to direct the ion beam entirely, or at least substantially, within an entrance ellipse and to provide the ion beam having a selected maximum spatial width, for example but without limitation, in the range of 2 mm to 3 mm. The entry lens can be sized so that most or all, but at a minimum a substantial part, of the ion beam is directed into the acceptance ellipse of the quadrupole rod set.

In certain configurations, the pressurized cell 750 can be configured in other configurations than a quadrupolar configuration. For example, radial confinement of ions can be provided within the cell 750 by forming a radial RF field within an elongated rod set. Confinement fields of this nature can, in general, be of different orders, but are commonly either a quadrupolar field, or else some higher order field, such as a hexapolar or octopolar field. For example, application of small DC voltages to a quadrupole rod set, in conjunction with the applied quadrupolar RF, can destabilize ions of m/z ratios falling outside of a narrow, tunable range, thereby creating a form of mass filter for ions. Suitable ion optics can be present upstream and/or downstream of the cell 750 if desired. For example, ion optic elements located upstream of a quadrupole rod set can also be configured so as to control each respective energy distribution, for example in terms of the corresponding range, of the various ion populations in the ion beam and to minimize energy separation during transmission from an ionization source to the quadrupole rod set. One aspect of this control can involve maintaining an entry lens at or slightly less than ground potential, thereby minimizing any ion field interactions at the entry lens that could otherwise cause energy separation in the ion populations. For example, the entry lens can be supplied by a power supply with an entrance potential falling in the range between −60 Volts and +20 Volts. Similarly, where an exit lens is present, the exit lens can be supplied by a power supply with an exit potential falling in the range between −30 Volts and +30 Volts. In some examples, a single voltage source may provide power to both the exit and entrance lenses, whereas in other configurations, each of the exit and entrance lenses can be electrically coupled to their own respective voltage source. In one illustration, the entry lens may comprise an entry lens orifice of about 4 mm to about 5 mm. The exit lens orifice can be smaller or larger than the entrance lens orifice, and in some instances comprises an orifice of about 2.5 mm to about 3.5 mm. Other size orifices may be viable as well to receive and eject the ion beam from the pressurized cell.

Figure 8A:
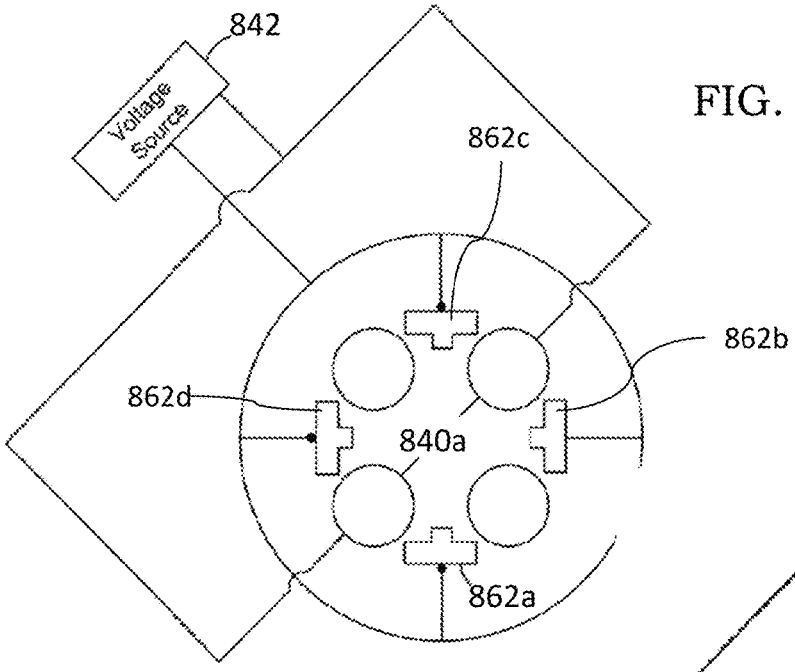
FIGS. 8A and 8B are illustration of a quadrupolar rod set of a collision-reaction cell, in accordance with some examples.
Figure 8B:
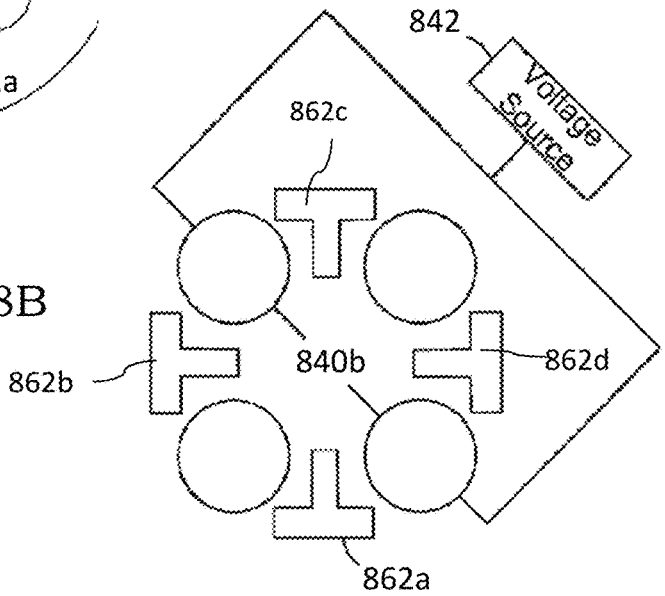

In certain configurations, the ion cloud within the collision-reaction cell may also be broadened using methods other than pressure though pressurization can be used in combination with these other methods if desired. Referring again to FIGS. 8A and 8B, in front and rear cross-sectionals views, respectively, are axial electrodes 862*a*-862*d* that can be included in alternative embodiments of the collision-reaction cell. The axial electrodes 862*a*-862*d* can be included in the cell to broaden the ion cloud either independently of pressure or in addition to pressure. For example, where a pressurized cell is used to broaden an ion cloud, the axial electrodes 862-862*d* can be used to further tune or enhance broadening of the ion cloud within the rod sets 840*a*, 840*b* of the cell. In comparison to using a conventional reaction-collision cell with auxiliary electrodes, the voltages applied to the axial electrodes 862*a*-862*d* can be lower to permit broadening of the ion cloud. For example, suitable voltages provided to the axial electrodes 862*a*-862*d* may be 10% less, 20% less, 30% less, 40% less or even 50% less than voltages applied to axial electrodes used with a pressurized cell configured to implement collision (KED)-reaction (DRC) modes as described in U.S. Pat. No. 8,426,804. In some examples, the voltages used to broaden the ion cloud may vary from about +500 Volts to about −500 Volts. In some instances, the voltages used to broaden the ion cloud may vary from about +50 Volts to about −50 Volts. If at a certain voltage provided to the axial electrodes, the ion cloud is not broadened sufficiently to provide a desired number of non-zero values, then the voltage is typically lowered (or even switched to a negative voltage) until a desired number of non-zero values are obtained for each analyte of interest in the single system. The auxiliary electrodes 862*a*-862*d* can have a generally T-shaped cross-section (though other shapes are possible), comprising a top portion and a stem portion that extends radially inwardly toward the longitudinal axis of quadrupole rod set. The radial depth of the stem blade section can vary along the longitudinal axis to provide a tapered profile along the length of the axial electrodes 862*a*-862*d*, though axial electrodes of constant radius can also be used. FIG. 8A shows the axial electrodes 862 from the exit end of the cell looking upstream toward the entrance end, and FIG. 8B shows the reverse perspective looking from the entrance end of the cell downstream to the exit end. The inward radial extension of the stem portions lessens moving downstream along the auxiliary electrodes 862*a*-862*d*. Each individual electrode can be electrically coupled together to the voltage source 842 to receive a DC voltage. In some examples, the geometries for the axial electrodes 862*a*-862*d* could be used to equal effect, including, but not limited to, segmented electrodes, divergent rods, inclined rods, as well as other geometries of tapered rods and reduced length rods.

In certain configurations, a processor (not shown) can also be electrically coupled to the voltage source 842 so that the provided DC voltage to the auxiliary electrodes 862*a*-862*d* forms an axial field of a selected field strength. The magnitude of the applied axial field strength can be determined by the processor based upon the desired broadening of the ion cloud to be achieved. In some embodiments, the processor may sequentially alter the axial field strength until a desired number of non-zero data values for two or more analytes present in a single system are obtained. For example, a first DC voltage can be provided to the axial electrodes 862*a*-862*d* in a dual analyte mode. Signals or data values for a first analyte and a second analyte can be detected. If the number of detected non-zero data values for the first analyte and a second analyte is less than desired, then a second DC voltage, which is less than the first DC voltage, can be used to enhance broadening of the ion cloud in the cell. Signals or data values for the first analyte and the second analyte can then be detected when the second DC voltage is used. If the number of non-zero data values for the first analyte and a second analyte is less than desired when the second DC voltage is used, then a third DC voltage, less than the second DC voltage, can be used to additionally broaden the ion cloud. This process can be repeated until a desired number of non-zero data values for each of a first analyte and a second analyte in a single system are obtained. As noted herein, these non-zero data values can be used to generate an intensity curve for the first analyte and an intensity curve for the second analyte. Each of the generated intensity curves can then be used to determine an amount of each of the first analyte and the second analyte in the single system.

In certain configurations, alteration of an axial field strength can be performed in combination with pressurization of the collision-reaction cell to broaden the ion cloud. For example, by controlling the cell pressure and the axial field strength, an ion cloud can be broadened further. In some examples, a constant pressure within the collision-reaction cell can be used, and the axial field strength can be altered until a desired broadening of the ion cloud is achieved. In other instances, a constant axial field strength can be used, and the pressure within the collision-reaction cell can be altered until a desired broadening of the ion cloud is achieved. In further configurations, both the pressure within the collision-reaction cell and axial field strength can be altered until a desired broadening of the ion cloud is achieved. Where both cell pressurization and axial field strength alteration are used, the collision-reaction cell pressure can be altered, for example, between a range of about 1 milliTorr to about 100 milliTorr. For example, the cell can be pressurized to about 5 milliTorr to about 50 milliTorr, e.g., to 10, 20, 30 or 40 milliTorr, by introducing a suitable gas or gas mixture into the cell. The combination of axial field strength and pressure may permit the use of a lower pressure than used where pressure by itself is used to broaden an ion cloud. Where pressure is used in combination with alteration of an axial field, the voltages applied to the axial electrodes can vary from about +500 Volts to about −500 Volts. In some instances, the voltages used to broaden the ion cloud, when used with cell pressurization, may vary from about +50 Volts to about −50 Volts. The combination of axial field strength and pressure may permit the use of higher, e.g., less negative voltages or more positive voltages, than those voltages used where axial field strength by itself is used to broaden an ion cloud.

Figure 9:
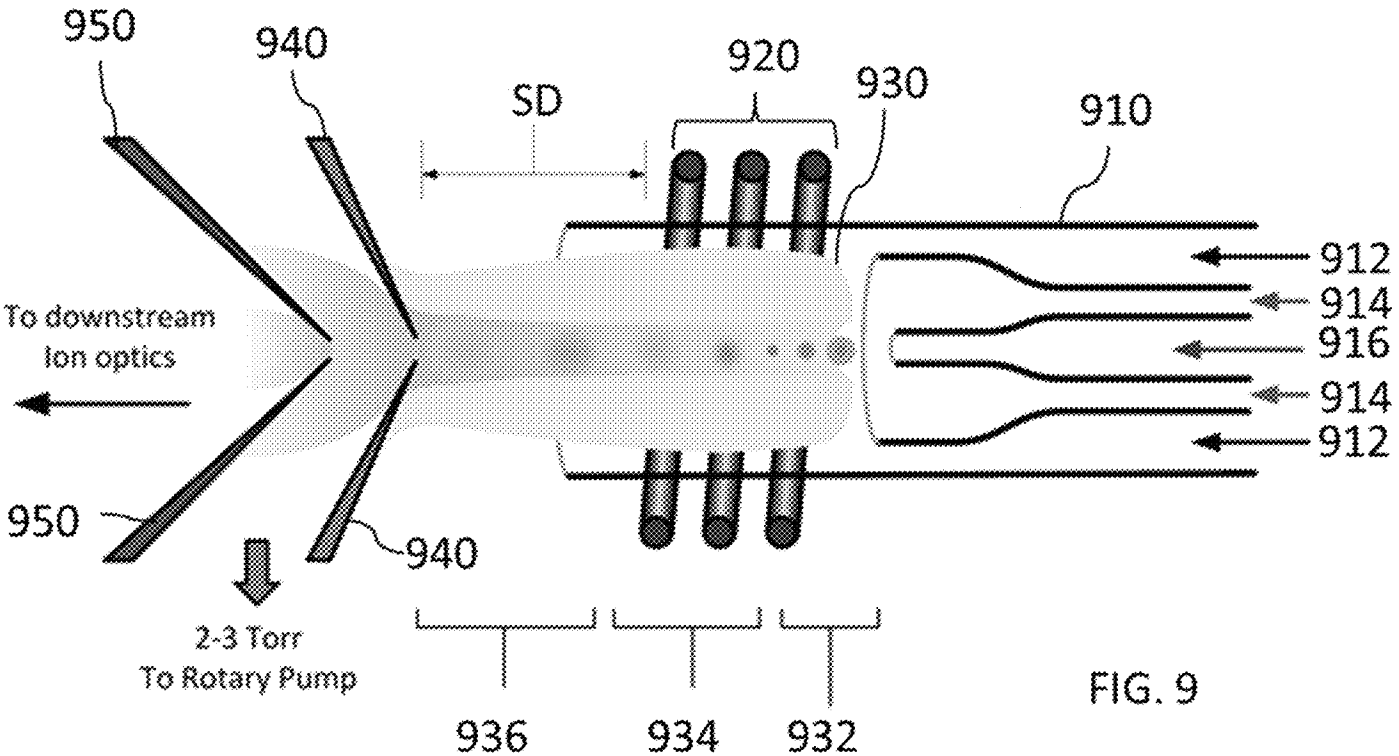
FIG. 9 is an illustration showing an ionization source and several interfaces, in accordance with certain examples.
Figure 10:
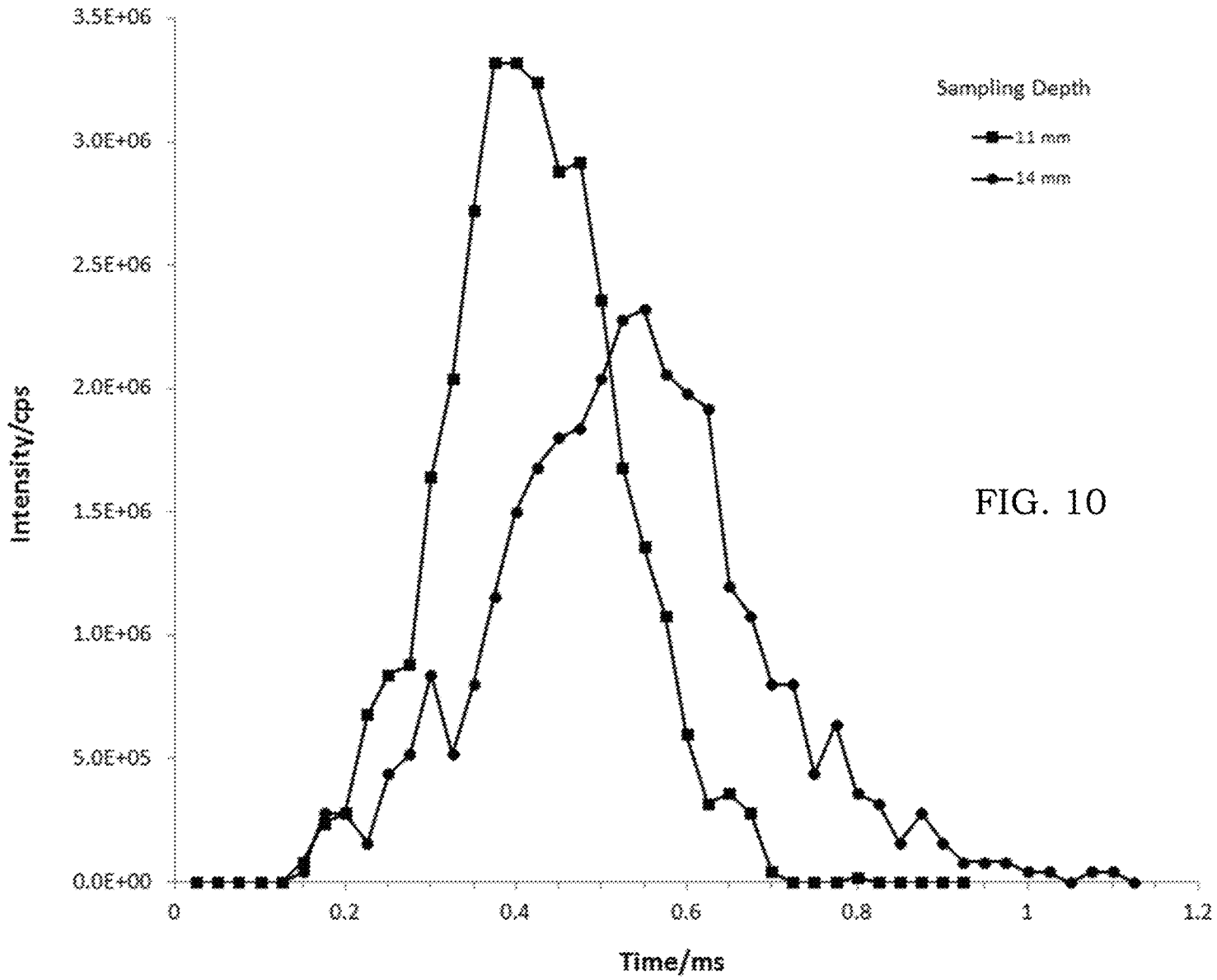
FIG. 10 is a graph showing the effect of altering sampling depth, in accordance with certain configurations.

In certain examples, broadening of an ion cloud can also be produced by altering a sampling depth of the MS system. The sampling depth is generally the distance between a front end of the ionization region of an ionization source (such as a plasma) and a front end of a sampling interface. FIG. 9 shows an illustration of certain components including an ionization source configured as an inductively coupled plasma 930 sustained in a torch 910 using an induction device 920, which is a load coil in this example. In a typical configuration, an outer gas flow 912, an intermediate gas flow 914 and an inner gas flow 916 are used to sustain the plasma 930 and cool the torch 920. Suitable gases include argon and other gases such as, for example, air. The exact flow of gases used can vary from about 20 Liters/minute to under 5 Liters/minute in the case of low flow plasma torches. The plasma 930 can be considered as including several different regions including a desolvation region 932, a vaporization/atomization region 934 and an ionization/diffusion region 936. As ions exit the ionization/diffusion region 936 of the plasma 930 they are drawn into a sampling interface 940 and then provided to a downstream skimmer interfaces 940 due to pressure differences between the interfaces 940, 950 and the plasma 930. Ion optics (not shown) may also be used to focus the ions. The components shown in FIG. 9 typically reside upstream of a deflector such as the deflector 740 shown in FIG. 7A. A sampling depth (SD) can be considered a distance between a front end of the ionization region 936 (or end of the vaporization/atomization region 934) and the front surface of the sampling interface 940. In certain configurations, the exact sampling depth used to broaden the ion cloud can vary. For example, it can be possible to increase the sampling depth to permit the ion cloud to broaden/diffuse more in the plasma 930 prior to entry into the sampling interface 940. Referring to FIG. 10, two illustrative curves 1010 and 1020 are shown. The peak height is more intense for the curve 1010, but the curve 1020 is broader due to an increase in sampling depth from 11 mm (curve 1010) to 14 mm (curve 1020). By increasing the sampling depth, the duration of a transient event can be increased to permit the detection of additional non-zero data values for an analyte.

In certain examples, the increase in sampling depth can be performed by moving the torch 910, the sampling interface 940 or both. In some instances, either or both of the components 910, 940 can be coupled to a motor to permit movement of the components relative to each other to alter the sampling depth. The exact sampling depth used may depend, at least in part, on the analyte ions in the sample with suitable sampling depths varying from about 7 mm to about 15 mm.

In some examples, alteration of pressure in the pressurized cell can be used in combination with altering sampling depth to broaden an ion cloud. For example, both the pressure in the collision-reaction cell and sampling depth may be altered to increase a duration of a transient event. In some examples where both pressurization of a collision-reaction cell and alteration of sampling depth are used to broaden an ion cloud, the collision-reaction cell pressure can be altered, for example, between a range of about 1 milliTorr to about 100 milliTorr. For example, the collision-reaction cell can be pressurized to about 5 milliTorr to about 50 milliTorr, e.g., to 10, 20, 30 or 40 milliTorr, by introducing a suitable gas or gas mixture into the collision-reaction cell. The combination of sampling depth alteration and pressure may permit the use of a lower pressure than the pressure used when pressure by itself is used to broaden an ion cloud. Where both pressurization of a collision-reaction cell and alteration of sampling depth are used to broaden an ion cloud, the sampling depth can be altered between a range of about 7 mm to about 15 mm. The combination of sampling depth alteration and pressure may permit the use of a lower sampling depth than a sampling depth used when sampling depth by itself is used to broaden an ion cloud.

In other examples, alteration of axial field intensity in the pressurized cell can be used in combination with altering sampling depth to broaden an ion cloud. For example, both the axial field strength in the collision-reaction cell and sampling depth may be altered to increase a duration of a transient event. Where sampling depth alteration is used in combination with alteration of an axial field, the voltages applied to the axial electrodes can vary from about +500 Volts to about −500 Volts. In some instances, the voltages used to broaden the ion cloud, when used with alteration of sampling depth, may vary from about +50 Volts to about −50 Volts. The combination of axial field strength and sampling depth alteration may permit the use of higher, e.g., less negative voltages or more positive voltages, than those voltages used where axial field strength is used by itself is used to broaden an ion cloud. Where both axial field strength alteration in a collision-reaction cell and alteration of sampling depth are used to broaden an ion cloud, the sampling depth can be altered between a range of about 7 mm to about 15 mm. The combination of sampling depth alteration and alteration of axial field strength may permit the use of a lower sampling depth than a sampling depth used when sampling depth by itself is used to broaden an ion cloud.

In some examples, alteration of axial field intensity in the pressurized cell and alteration of pressure in the pressurized cell can be used with altering sampling depth to broaden an ion cloud. By being able to alter all three parameters, the number of non-zero data values that can be obtained when analyzing two or more analytes in a single system can be tuned as desired.

In certain examples where pressurization of a collision-reaction cell, alteration of axial field strength and alteration of sampling depth are used to broaden an ion cloud, the collision-reaction cell pressure can be altered, for example, between a range of about 1 milliTorr to about 100 milliTorr. For example, the collision-reaction cell can be pressurized to about 5 milliTorr to about 50 milliTorr, e.g., to 10, 20, 30 or 40 milliTorr, by introducing a suitable gas or gas mixture into the collision-reaction cell. The combination of sampling depth alteration, axial field strength alteration and pressure may permit the use of a lower pressure than the pressure used when pressure by itself is used to broaden an ion cloud. The combination of sampling depth alteration, axial field strength alteration and pressure may also permit the use of a lower pressure as compared to the pressure used when pressure is used only in combination with one of sampling depth alteration or axial field strength alteration. Where pressure, axial field strength alteration and sampling depth alteration are used in combination, the voltages applied to the axial electrodes can vary from about +500 Volts to about −500 Volts. In some instances, the voltages used to broaden the ion cloud, when used with alteration of sampling depth and pressure, may vary from about +50 Volts to about −50 Volts. The combination of axial field strength, collision-reaction cell pressure and sampling depth alteration may permit the use of higher, e.g., less negative voltages or more positive voltages, than those voltages used where axial field strength is used by itself is used to broaden an ion cloud. The combination of axial field strength, collision-reaction cell pressure and sampling depth alteration may also permit the use of higher, e.g., less negative voltages or more positive voltages, than those voltages used where axial field strength is used in combination with one of collision-reaction cell pressure or sampling depth alteration. Where axial field strength alteration in a collision-reaction cell, pressure in the collision-reaction cell and alteration of sampling depth are used to broaden an ion cloud, the sampling depth can be altered between a range of about 7 mm to about 15 mm. The combination of sampling depth alteration, collision-reaction cell pressure and alteration of axial field strength may permit the use of a lower sampling depth than a sampling depth used when sampling depth by itself is used to broaden an ion cloud. The combination of sampling depth alteration, collision-reaction cell pressure and alteration of axial field strength may also permit the use of a lower sampling depth than a sampling depth used when sampling depth is used in combination with one of collision-reaction cell pressure or axial field strength alteration.

In certain embodiments, the methods and system described herein can be used to fill in missing data gaps when two or more different analytes within the same system, e.g., within the same nanoparticle, nanostructure, microparticle, microstructure, etc. are detected. A liquid sample comprising the single system is typically diluted such that single nanoparticles, nanostructures, etc. are introduced into the ionization source. Ionization of the single system provides a transient event representative of an ion cloud comprising the two or more analytes within the single system. As the ion cloud comprising the two or more analytes exits the ionization source, any one or more of cell pressure, axial field strength and/or sampling depth may be altered to broaden the ion cloud to permit detection of a sufficient amount of non-zero data values for each of the first analyte and the second analyte in the single system. For example, as the analytes in the broadened ion cloud exit the cell, the first analyte can be selected for detection followed by selection of the second analyte for detection. This process of sequentially detecting first analyte ions and then second analyte ions may be repeated over the entire transient event to collect non-zero data values representative of the first analyte ions and the second analyte ions. An intensity curve may then be generated for each of the first analyte and the second analyte using numerous methods including fitting a curve to the data values for each of the first analyte and the second analyte. Peak height, peak areas or both of the generated intensity curves can be used to quantify the amount of each of the first analyte and the second analyte present in the single system.

Figure 11A:
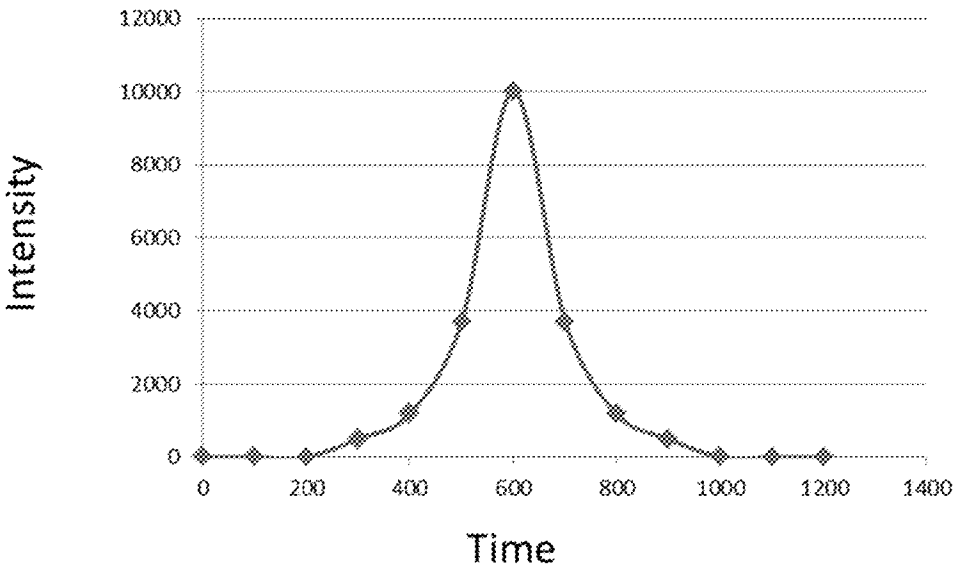
FIG. 11A is a graph showing measurement of a single analyte from a non-broadened ion cloud, in accordance with certain embodiments.
Figure 11B:
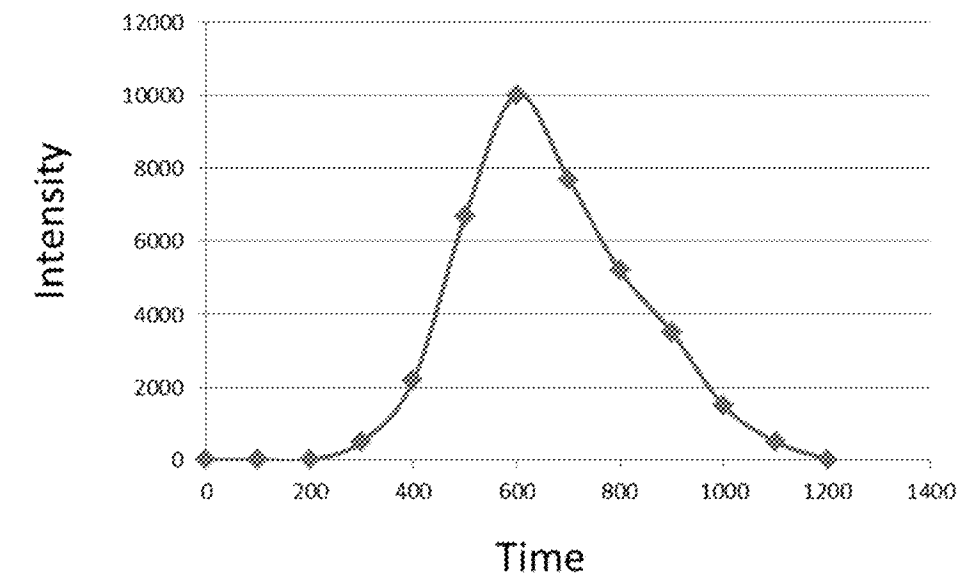
FIG. 11B is a graph showing measurement of the single analyte from FIG. 11A but after broadening of the ion cloud, in accordance with certain embodiments.
Figure 12A:
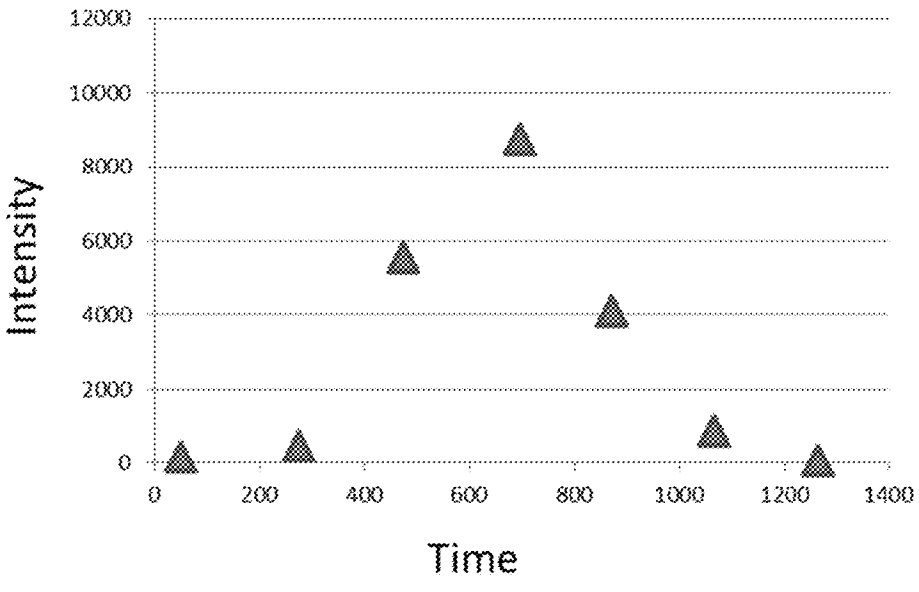
FIG. 12A is a graph showing detected data values for a first analyte when a MS instrument is operated in a dual analyte mode, in accordance with certain configurations.
Figure 12B:
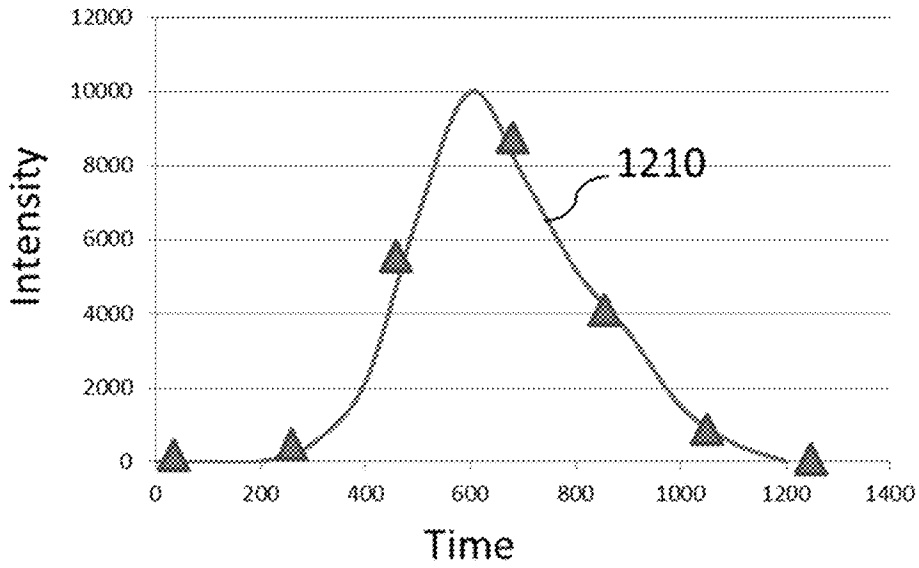
FIG. 12B is a graph showing an intensity curve fitted to the detected data values of FIG. 12A, in accordance with certain examples.

In certain examples, prior to detecting the first analyte and the second analyte using the methods and systems described herein, a pre-scan may be performed where signals or data values for only a single analyte are detected. Referring to FIG. 11A, a pre-scan is shown where the system is operated in a single analyte mode only to determine a curve shape for a first analyte. Where one or more of the collision-reaction cell pressure, axial field electrode voltages and/or sampling depth are to be altered, the alterations can be made and another pre-scan (FIG. 11B) can be performed to determine a curve shape under those conditions. As can be seen in FIG. 11B, more non-zero data values are obtained after the ion cloud is broadened. The obtained pre-scan curve shape from FIG. 11B can be used to obtain a curve shape for the first analyte when the MS system is operated in the dual analyte mode. Referring to FIG. 12A, data values are shown for the first analyte when the MS system is operated in the dual analyte mode. As can be seen, there are large gaps in the data due to switching between detection of the first analyte and a second analyte. The data values for the second analyte are not shown. The curve obtained in the pre-scan mode (FIG. 11B) can be used to fit the obtained data values in the dual analyte mode. Referring to FIG. 12B, the pre-scan curve obtained in the single analyte mode for the first analyte has been used to generate an intensity curve for the data obtained for the first analyte in the dual analyte mode. The determined peak shape in the single analyte mode is used to estimate the intensities of the missing data values for the first analyte when the MS system is operated in the dual analyte mode and provides an intensity curve 1210 for the first analyte. This methodology permits an accurate determination of the amount of the first analyte in the single system, e.g., using peak height, peak area or both of the intensity curve 1210 of FIG. 12B. A similar methodology can be implemented for the second analyte to quantify both the amount of the first analyte and the second analyte in the transient sample, e.g., in the single system. While not described, the amount of three or more analytes present in the single system can also be quantified using a similar methodology.

In some embodiments, the methodology used in reference to FIGS. 11A-12B can also be used in situations where ion cloud broadening is not needed. For example, certain samples may have long transient events so that there is no need to broaden the ion cloud to obtain a sufficient amount of non-zero data values. In instances where a plume of solid sample formed by laser ablation or a vapor plug formed by electrothermal vaporization is introduced into the MS system, no broadening of the ion cloud may be needed in order to measure two or more analytes present in the plume of solid sample formed by laser ablation or a vapor plug formed by electrothermal vaporization. The MS system can be operated without a pressurized collision-reaction cell, if desired, when these sample types are used and/or sampling depth may be constant. In other configurations, a collision-reaction cell can be present, but the voltages used may not be designed to broaden the ion cloud. Alternatively, where the plume of solid sample formed by laser ablation or a vapor plug formed by electrothermal vaporization is broad, the collision-reaction cell voltages can be used to narrow or focus the ion cloud if desired. When measuring two or more analytes in a solid sample formed by laser ablation or a vapor plug formed by electrothermal vaporization, data gaps will still exist, however, as the MS system is switched between detection of the two or more analytes. The ion cloud produced by a solid sample formed by laser ablation or a vapor plug formed by electrothermal vaporization may be sufficiently broad on its own to obtain two or more non-zero data values. A pre-scan in the single analyte mode using the solid sample formed by laser ablation or a vapor plug formed by electrothermal vaporization can be used to generate a pre-scan curve for the first analyte. The pre-scan curve can be used to generate an intensity curve for the first analyte when the MS system is operated in the dual analyte mode, e.g., by using the pre-scan curve to estimate the intensities of the missing data values that were not measured for the first analyte. A pre-scan curve for the second analyte can be used to generate an intensity curve for the second analyte when the MS system is operated in the dual analyte mode, e.g., by using the pre-scan curve to estimate the intensities of the missing data values that were not measured for the second analyte. This methodology permits construction of two intensity curves (one for each analyte) that can be used to quantify the amount of each of the first analyte and the second analyte present in the single system. While not described, the amount of three or more analytes present in the plume of solid sample formed by laser ablation or a vapor plug formed by electrothermal vaporization can also be quantified using a similar methodology.

In certain embodiments, the methods and systems described herein may use a processor to fit the intensity curves to the data values, to fit the pre-scan curves to the data values and/or to determine the amount of each analyte present in the single system. Such processes may be performed automatically by the processor without the need for user intervention. For example, the processor can use peak heights or peaks areas (or both) of the analyte intensity curves to determine how much of each analyte is present in the single system. The processor may compare, for example, peak heights or peaks areas (or both) to calibration curves stored in the system (or on the processor) to determine the amount of each of the analytes present in the single system. In certain configurations, the processor may be present in one or more computer systems and/or common hardware circuitry including, for example, a microprocessor and/or suitable software for operating the system, e.g., to control the collision-reaction cell voltages, axial electrode voltages, sampling depth, pumps, mass analyzer, detector, etc. In some examples, the MS system itself may comprise its own respective processor, operating system and other features to permit operation or control of the collision-reaction cell pressures and voltages, the axial field electrode voltages and/or the sampling depth. The processor can be integral to the systems or may be present on one or more accessory boards, printed circuit boards or computers electrically coupled to the components of the system. The processor is typically electrically coupled to one or more memory units to receive data from the other components of the system and permit adjustment of the various system parameters as needed or desired. The processor may be part of a general-purpose computer such as those based on Unix, Intel PENTIUM-type processor, Motorola PowerPC, Sun UltraSPARC, Hewlett-Packard PA-RISC processors, or any other type of processor. One or more of any type computer system may be used according to various embodiments of the technology. Further, the system may be connected to a single computer or may be distributed among a plurality of computers attached by a communications network. It should be appreciated that other functions, including network communication, can be performed and the technology is not limited to having any particular function or set of functions. Various aspects may be implemented as specialized software executing in a general-purpose computer system. The computer system may include a processor connected to one or more memory devices, such as a disk drive, memory, or other device for storing data. Memory is typically used for storing programs, calibration curves, analyte intensity curves and data values during operation of the MS system. Components of the computer system may be coupled by an interconnection device, which may include one or more buses (e.g., between components that are integrated within a same machine) and/or a network (e.g., between components that reside on separate discrete machines). The interconnection device provides for communications (e.g., signals, data, instructions) to be exchanged between components of the system. The computer system typically can receive and/or issue commands within a processing time, e.g., a few milliseconds, a few microseconds or less, to permit rapid control of the system to switch the collision-reaction cell pressure, the axial field strength and/or the sampling depth. For example, computer control can be implemented to control the pressure within the collision-reaction cell, voltages provided to the collision-reaction cell and/or axial field electrodes, etc. The processor typically is electrically coupled to a power source which can, for example, be a direct current source, an alternating current source, a battery, a fuel cell or other power sources or combinations of power sources. The power source can be shared by the other components of the system. The system may also include one or more input devices, for example, a keyboard, mouse, trackball, microphone, touch screen, manual switch (e.g., override switch) and one or more output devices, for example, a printing device, display screen, speaker. In addition, the system may contain one or more communication interfaces that connect the computer system to a communication network (in addition or as an alternative to the interconnection device). The system may also include suitable circuitry to convert signals received from the various electrical devices present in the systems. Such circuitry can be present on a printed circuit board or may be present on a separate board or device that is electrically coupled to the printed circuit board through a suitable interface, e.g., a serial ATA interface, ISA interface, PCI interface or the like or through one or more wireless interfaces, e.g., Bluetooth, Wi-Fi, Near Field Communication or other wireless protocols and/or interfaces.

In certain embodiments, the storage system used in the systems described herein typically includes a computer readable and writeable nonvolatile recording medium in which codes of software can be stored that can be used by a program to be executed by the processor or information stored on or in the medium to be processed by the program. The medium may, for example, be a hard disk, solid state drive or flash memory. Typically, in operation, the processor causes data to be read from the nonvolatile recording medium into another memory that allows for faster access to the information by the processor than does the medium. This memory is typically a volatile, random access memory such as a dynamic random access memory (DRAM) or static memory (SRAM). It may be located in the storage system or in the memory system. The processor generally manipulates the data within the integrated circuit memory and then copies the data to the medium after processing is completed. A variety of mechanisms are known for managing data movement between the medium and the integrated circuit memory element and the technology is not limited thereto. The technology is also not limited to a particular memory system or storage system. In certain embodiments, the system may also include specially-programmed, special-purpose hardware, for example, an application-specific integrated circuit (ASIC) or a field programmable gate array (FPGA). Aspects of the technology may be implemented in software, hardware or firmware, or any combination thereof. Further, such methods, acts, systems, system elements and components thereof may be implemented as part of the systems described above or as an independent component. Although specific systems are described by way of example as one type of system upon which various aspects of the technology may be practiced, it should be appreciated that aspects are not limited to being implemented on the described system. Various aspects may be practiced on one or more systems having a different architecture or components. The system may comprise a general-purpose computer system that is programmable using a high-level computer programming language. The systems may be also implemented using specially programmed, special purpose hardware. In the systems, the processor is typically a commercially available processor such as the well-known Pentium class processors available from the Intel Corporation. Many other processors are also commercially available. Such a processor usually executes an operating system which may be, for example, the Windows 95, Windows 98, Windows NT, Windows 2000 (Windows ME), Windows XP, Windows Vista, Windows 7, Windows 8 or Windows 10 operating systems available from the Microsoft Corporation, MAC OS X, e.g., Snow Leopard, Lion, Mountain Lion or other versions available from Apple, the Solaris operating system available from Sun Microsystems, or UNIX or Linux operating systems available from various sources. Many other operating systems may be used, and in certain embodiments a simple set of commands or instructions may function as the operating system.

In certain examples, the processor and operating system may together define a platform for which application programs in high-level programming languages may be written. It should be understood that the technology is not limited to a particular system platform, processor, operating system, or network. Also, it should be apparent to those skilled in the art, given the benefit of this disclosure, that the present technology is not limited to a specific programming language or computer system. Further, it should be appreciated that other appropriate programming languages and other appropriate systems could also be used. In certain examples, the hardware or software can be configured to implement cognitive architecture, neural networks or other suitable implementations. If desired, one or more portions of the computer system may be distributed across one or more computer systems coupled to a communications network. These computer systems also may be general-purpose computer systems. For example, various aspects may be distributed among one or more computer systems configured to provide a service (e.g., servers) to one or more client computers, or to perform an overall task as part of a distributed system. For example, various aspects may be performed on a client-server or multi-tier system that includes components distributed among one or more server systems that perform various functions according to various embodiments. These components may be executable, intermediate (e.g., IL) or interpreted (e.g., Java) code which communicate over a communication network (e.g., the Internet) using a communication protocol (e.g., TCP/IP). It should also be appreciated that the technology is not limited to executing on any particular system or group of systems. Also, it should be appreciated that the technology is not limited to any particular distributed architecture, network, or communication protocol.

In some instances, various embodiments may be programmed using an object-oriented programming language, such as, for example, SQL, SmallTalk, Basic, Java, Javascript, PHP, C++, Ada, Python, iOS/Swift, Ruby on Rails or C# (C-Sharp). Other object-oriented programming languages may also be used. Alternatively, functional, scripting, and/or logical programming languages may be used. Various configurations may be implemented in a non-programmed environment (e.g., documents created in HTML, XML or other format that, when viewed in a window of a browser program, render aspects of a graphical-user interface (GUI) or perform other functions). Certain configurations may be implemented as programmed or non-programmed elements, or any combination thereof. In some instances, the systems may comprise a remote interface such as those present on a mobile device, tablet, laptop computer or other portable devices which can communicate through a wired or wireless interface and permit operation of the systems remotely as desired.

In certain examples, the processor may also comprise or have access to a database of information about atoms, molecules, ions, and the like, which can include the m/z ratios of these different compounds, ionization energies, and other common information. The database can include further data relating to the general curve shapes of analyte ions of interest under specific collision-reaction cell pressures, axial field strengths and/or sampling depths. For example, a collection of pre-scan curves for different analytes can be stored in the database and used to estimate analyte intensity curves in a dual analyte mode of the MS without the need for the user to pre-scan each of the analytes. Such methods may be particularly desirable where the amount of sample is limited. The instructions stored in the memory can execute a software module or control routine for the system, which in effect can provide a controllable model of the system. The processor can use information accessed from the database together with one or software modules executed in the processor to determine control parameters or values for different components of the mass spectrometer. Using input interfaces to receive control instructions and output interfaces linked to different system components in the mass spectrometer system, the processor can perform active control over the system. For example, the processor can control gas pressures within the collision-reaction cell, the nature of the gas introduced into the collision-reaction cell (by altering the gas source fluidically coupled to the collision-reaction cell), voltages provided to the axial field electrodes and/or the sampling depth. The processor can also control any voltages provided to ion optics upstream or downstream of the collision-reaction cell.

In certain embodiments, the exact ionization source used with the cells and systems described herein can vary. In a typical configuration, the ionization source is operative to generate analyte ions from an aerosolized sample introduced into the ionization source. For certain mass spectrometry applications, for example those involving analysis of metals and other inorganic analytes, analysis can be desirably performed using an inductively coupled plasma (ICP) ion source in the mass spectrometer, due to the relatively high ion sensitivities that can be achieved in ICP-MS. To illustrate, ion concentrations below one part per billion are achievable with ICP ion sources. As noted above, in a conventional inductively coupled plasma ion source, the end of a torch consisting of three concentric tubes, typically quartz tubes, can be placed within an aperture formed by an induction coil provided with a radio-frequency electric current. A flow of argon gas can then be introduced between the two outermost tubes of the torch, where the argon atoms can interact with the radio-frequency magnetic field of the induction coil to free electrons from the argon atoms. This action can produce a very high temperature plasma, e.g., 10,000 Kelvin, comprising mostly of argon atoms with a small fraction of argon ions and free electrons. The single system can then be introduced into the argon plasma, for example as a nebulized mist of liquid. Droplets of the nebulized sample can evaporate, with any solids dissolved in the liquid being broken down into atoms and, due to the extremely high temperatures in the plasma, stripped of their most loosely-bound electron to form a singly charged ion. Where a single cell or a single nanoparticle or a single nanostructure is introduced in the plasma, the organic material is broken down completely into constituent ions or atoms, and any elemental species present in the single cells or single nanoparticles or single nanostructures tend to form elemental analyte ions which can be detected using the methods and systems described herein. While conventional ICP sources can be used with the cells and systems described herein, low flow plasmas, capacitively coupled plasmas and the like may also be used with the cells and systems described herein. Various plasmas and devices used to produce them are described, for example, in U.S. Pat. Nos. 7,106,438, 7,511,246, 7,737,397, 8,633,416, 8,786,394, 8,829,386, 9,259,798, 9,504,137 and 9,433,073.

Figure 13:
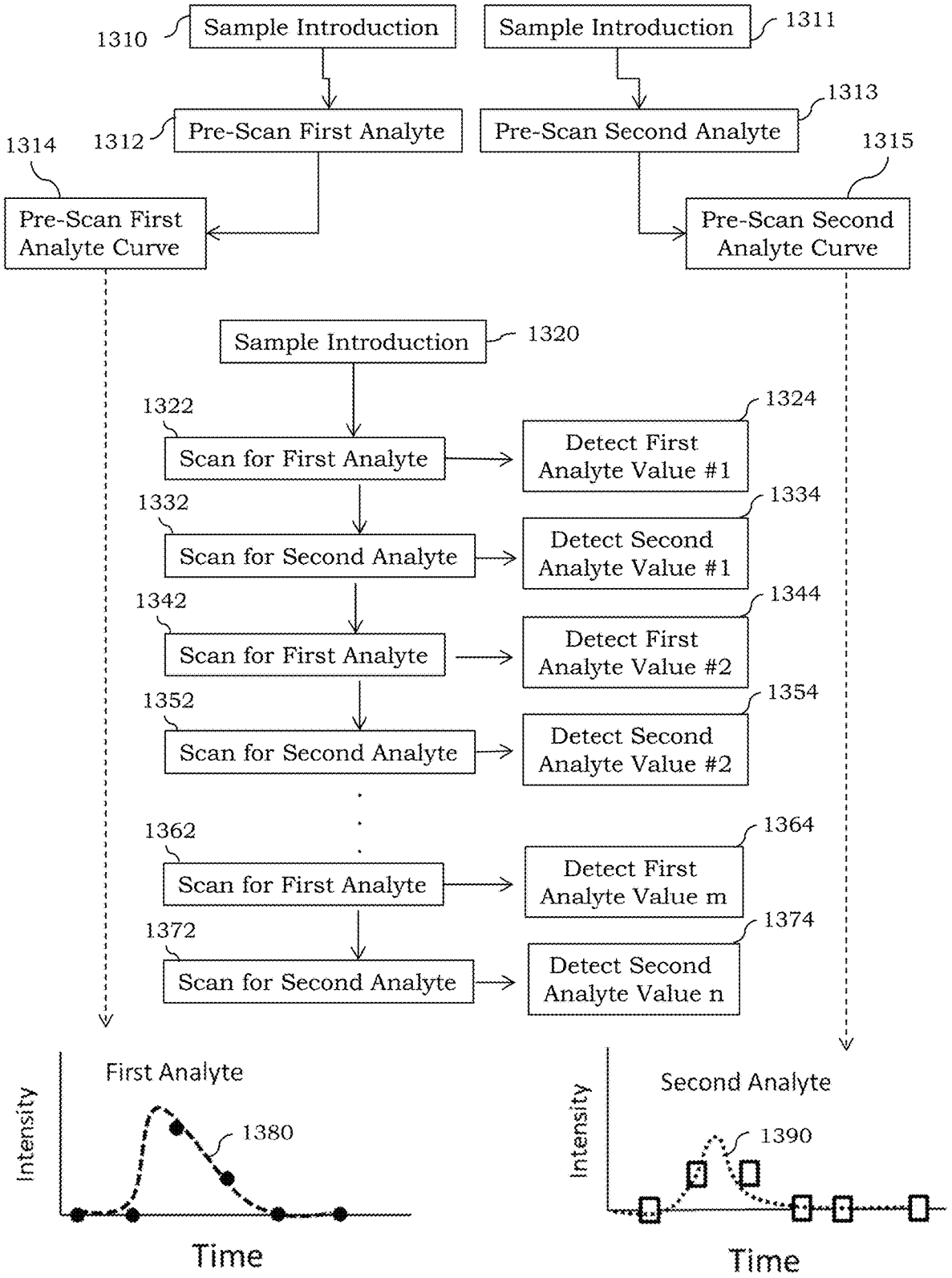
FIG. 13 shows a summary of certain steps that can be performed to quantity two or more analytes in a transient sample, in accordance with certain examples.
Figure 14:
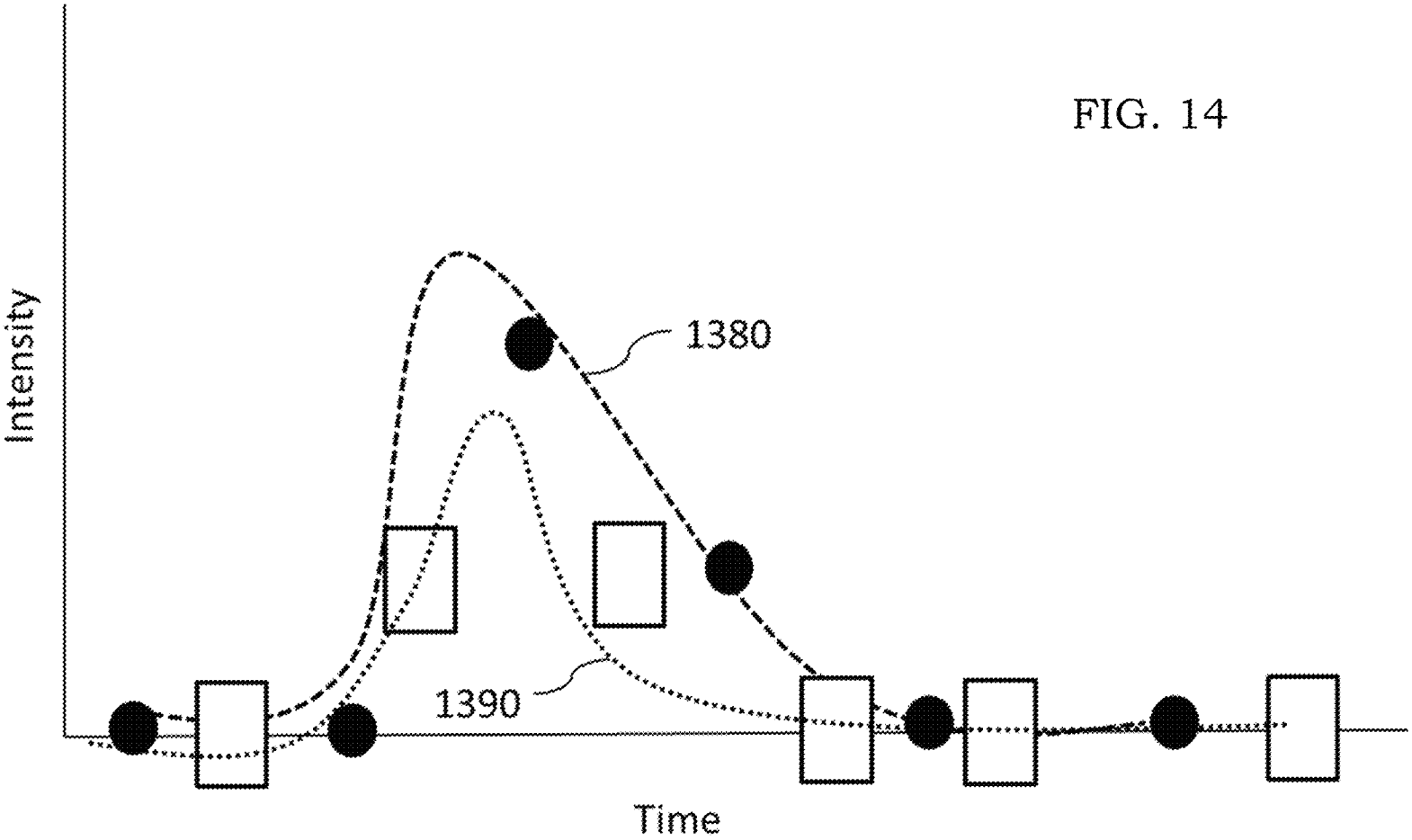
FIG. 14 is a graph showing detection values and intensity curves for a first analyte and a second analyte, in accordance with certain embodiments.

In certain embodiments, a summary of the steps used to quantify two or more analytes present in a single system is shown in FIG. 13. In a single analyte mode, sample is introduced at step 1310, and the MS instrument is scanned for the first analyte at a step 1312. As noted herein, the sample typically comprises a single system though samples which provide a plume of solid sample formed by the laser ablation or a vapor plug formed by electrothermal vaporization may also be used. A pre-scan first analyte curve may then be generated at step 1314 using the detected values for the first analyte. Sample is introduced at a step 1311, and the MS instrument is scanned for the second analyte at a step 1313. A pre-scan second analyte curve may then be generated at step 1315 using the detected values for the second analyte. If desired, a pre-scan curve may be generated in a similar manner for a third analyte, fourth analyte, etc. Sample is then introduced at a step 1320, and in the dual analyte mode the MS instrument is first scanned for the first analyte at a step 1322. A first analyte value is detected at a step 1324. The MS instrument is then configured, e.g., by switching a voltage provided to a rod set in the mass analyzer, to scan for the second analyte at a step 1332. A second analyte value is detected at a step 1334. The MS instrument is then switched back at a step 1342 to scan for the first analyte. Another first analyte value is detected at a step 1344. The MS instrument is then switched back at a step 1352 to scan for the second analyte. Another second analyte value is detected at a step 1354. This process is repeated until "m" values for the first analyte and "n" values for the second analyte are obtained. A graphical representation of the data values for each of the first analyte and the second analyte is shown in the graphs at the bottom of FIG. 13. The shape of the pre-scan first analyte curve obtained at step 1314 can be used to generate an intensity curve 1380 for the first analyte, and the shape of the pre-scan second analyte curve obtained at step 1315 can be used to generate an intensity curve 1390 for the first analyte. For example, an equation that represents the pre-scan first analyte curve can be used to generate an intensity curve for the first analyte using the obtained data values for the first analyte. Similarly, an equation that represents the pre-scan second analyte curve can be used to generate an intensity curve for the second analyte using the obtained data values for the first analyte. The generated intensity curves for the first analyte and the second analyte are both shown in FIG. 14 for comparison purposes. The peak height, peak area or both for each of the intensity curves 1380, 1390 can be used to determine an amount of the first analyte and the second analyte present in the sample, e.g., by comparing the peak height, peak area or both to calibration curves to determine an amount of the first analyte and the second analyte present in the single system. As noted herein, if an insufficient amount of non-zero data values are obtained for each of the first analyte and the second analyte, then one or more of sampling depth, axial field strength and collision-reaction cell pressure can be altered to broaden an ion cloud. The methodology shown in FIG. 13 may then be repeated under the new conditions to quantify an amount of the first analyte and the second analyte present in the sample.

Figure 15A:
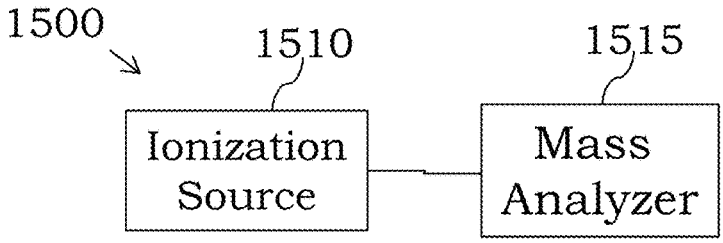
FIGS. 15A, 15B and 15C are block diagrams showing certain components that can be present in a mass spectrometer, in accordance with certain examples.
Figure 15B:
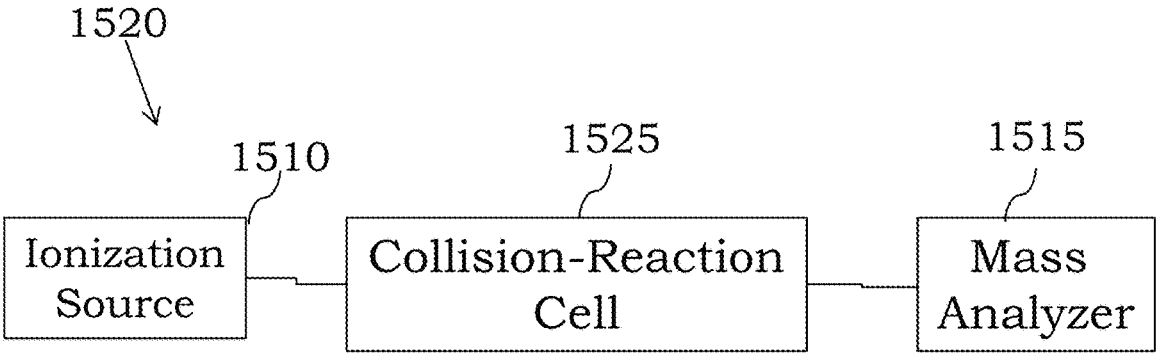
Figure 15C:
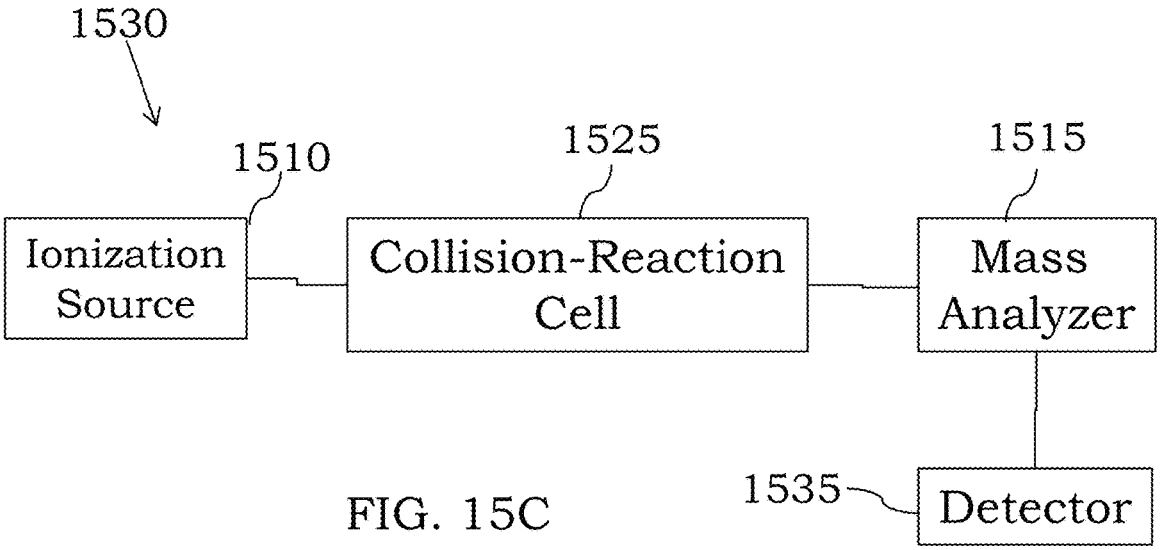

As noted herein, the exact configuration of mass spectrometer system can vary depending on the particular sample to be analyzed. In some instances and referring to FIG. 15A, the mass spectrometer comprises an ionization source 1505 fluidically coupled to a mass analyzer 1510. For example, in the case of samples that provide a plume of solid sample formed by the laser ablation or a vapor plug formed by electrothermal vaporization, the produced ion cloud may be sufficiently broad such that no collision-reaction cell is present in the MS system 1500, as such collision-reaction cells are not needed. If desired, however, one or more collision-reaction cells can be present (such as collision-reaction cell 1525 in MS system 1520 of FIG. 15B) to remove interferences and/or to subject the sample to a reaction or collision gas as desired. In some examples, an MS system 1530 may also comprise a detector 1535 fluidically coupled to the mass analyzer 1510 as shown in FIG. 15C. As noted herein, if desired, ion optics may be upstream or downstream (or both) of the collision-reaction cell 1525. In addition, one or more ion deflectors, interfaces, skimmers, etc. may also be present in the systems shown in FIGS. 15A-15C. Further, sample introduction devices such as nebulizers, aerosolizers, injectors, etc. may also be present. If desired, the mass spectrometer can be hyphenated to one or more chromatographic devices including, for example, a gas chromatograph or a high performance liquid chromatograph.

In certain configurations, the ionization source of the mass spectrometers described herein may vary, and illustrative ionization sources include, but are not limited to, inductively coupled plasmas, capacitively coupled plasmas, electron impact sources, matrix assisted laser desorption-ionization sources, electrospray ionization sources, thermal ionization, arcs, sparks, flames and other sources. In certain embodiments, the mass analyzer used in the mass spectrometers described herein may vary, and illustrative mass analyzers include, but are not limited to, single quadrupole, dual quadrupole, triple quadrupole, magnetic sector, double-focusing, quadrupole ion trap, cyclotron and other mass analyzers. In some examples, the exact detector used in the mass spectrometers described herein may vary, and illustrative detectors include, but are not limited to, Faraday cups, electron multipliers, scintillation plates, multi-channel plates, microchannel plates, micro-arrays and other detectors commonly used in mass spectrometers.

In certain embodiments, the nature of the single systems that can be analyzed using the methods and systems described herein may vary. Where the single system comprises a nanomaterial, the nanomaterial may comprise a molecular structure that is coordinated to, bonded to or otherwise interacting with one, two, three or more analytes. While not absolutely required, nanomaterials tend to be (or have one dimension) of about 1 to about 100 nanometers in size and may comprise a surrounding interfacial layer, surface agents, capping agents, etc. Nanostructures are similar to nanoparticles but may comprise one or more dimensions that are not on the nanoscale level. For example, a nanotextured surface may comprise one dimension on the nanoscale level. A nanotube may comprise two dimensions on the nanoscale level. Nanoparticles generally have three dimensions on the nanoscale level. Illustrative nanomaterials that can be analyzed using the method described herein include, but are not limited to, nanofilms, nanocages, nanospheres, nanorods, nanoboxes, nanoclusters, nanocups, nanofabrics, nanofoams, nanomeshes, nanoflowers, nanoflakes, nanocomposites, nanoholes, nanopillars, nanopins, nanopin films, nanoplatelets, nanoribbons, nanosheets, nanosheels, nanotips, nanowires, quantum dots, self-assembled nanomaterials and thin films comprising nanomaterials.

In some examples, micromaterials such as microparticles and microstructures can be analyzed using the methods described herein. Micromaterials generally have one or more dimensions on the 100 nm to 100 micron size. Certain biological cells may comprise a suitable size to be considered micromaterials. Microparticles, which generally have three dimensions on the microscale level, may include ceramic particles, glass particles, polymeric particles, dust particles and food particles such as sugars, flours, etc. Micromaterials often comprise one, two, three or more analytes which can be detected using the methods and systems described herein. For example, ceramic, glass, or polymeric microspheres (such as polyethylene, polypropylene, and polystyrene microspheres) often comprise two or more analytes in varying amounts. Hollow microspheres can be used as delivery agents to encapsulate a pharmaceutical agent such as a therapeutic or biological agent or may be used to decrease the density of certain plastic materials. Reflective microspheres can be added to paints to enhance light reflectivity. Clear microspheres are often used in the cosmetics industry as fillers or texturing agents to hide wrinkles or age spots.

In examples where a single biological cell or biological system is used for quantitation of two or more analytes using the methods described herein, the biological cell may be a bacterial cell, a fungal cell, a plant cell, a protista cell, an animal cell or a virus. Where the cell is a bacterial cell, the bacterial cell may be a cell from one or more of the Acidobacteria, Actinobacteria, Aquificae, Armatimonadetes, Bacteroidetes, Caldiserica, Chlamydiae, Chlorobi, Chloroflexi, Chrysiogenetes, Cyanobacteria, Deferribacteres, *Deinococcus-Thermus*, Dictyoglomi, Elusimicrobia, Fibrobacteres, Firmicutes, Fusobacteria, Gemmatimonadetes, Lentisphaerae, Nitrospirae, Planctomycetes, Proteobacteria, Spirochaetes, Synergistetes, Tenericutes, Thermodesulfobacteria, Thermotogae or Verrucomicrobia phyla. Illustrative classes, orders and/or families of bacterial cells that can be analyzed include, but are not limited to, those from Acidobacteria, Blastocatellia, Holophagae, Rubrobacteria, Thermoleophilia, Coriobacteriia, Acidimicrobiia, Nitriliruptoria, Actinobacteria, Aquificales, Aquificaceae, Hydrogenothermaceae, Desulfurobacteriales, Desulfurobacteriaceae, Thermosulfidibacter, Fimbriimonadia, Armatimonadia, Chthonomonadetes, Rhodothermia, Rhodothermales, Balneolia, Balneolales, Cytophagia, Cytophagales, Sphingobacteria, Sphingobacteriales, Chitinophagia, Chitinophagales, Bacteroidia, Bacteroidales, Flavobacteriia, Flavobacteriales, Caldisericaceae, Chlamydiales, Chlamydiaceae, Candidatus, Clavichlamydiaceae, Parachlamydiales, Criblamydiaceae, Parachlamydiaceae, Simkaniaceae, Waddliaceae, Candidatus Piscichlamydia, Candidatus Actinochlamydiaceae, Candidatus Parilichlamydiaceae, Candidatus Rhabdochlamydiaceae, Ignavibacteria, Ignavibacteriales, Ignavibacteriaceae, Ignavibacterium, Melioribacter, Chlorobea, Chlorobiales, Chlorobiaceae, Ancalochloris, *Chlorobaculum, Chlorobium*, Chloroherpeton, Clathrochloris, Pelodictyon, Prosthecochloris, Thermoflexia, Dehalococcoidia, Anaerolineae, Ardenticatenia, Caldilineae, Ktedonobacteria, Thermomicrobia, Chloroflexia, Chrysiogenetes, Chrysiogenales, Chrysiogenaceae, Chroococcales, Chroococcidiopsidales, Gloeobacterales, Nostocales, Oscillatoriales, Pleurocapsales, Spirulinales, Synechococcales, Incertae sedis, Deferribacterale, Deferribacteraceae, Deinococcales, Deinococcaceae, Trueperaceae, Thermales, Thermaceae, Dictyoglomales, Dictyoglomaceae, Elusimicrobia, Endomicrobia, Blastocatellia, Chitinispirillia, Chitinivibrionia, Fibrobacteria, Bacilli, Bacillales, Lactobacillales, Clostridia, Clostridiales, Halanaerobiales, Natranaerobiales, Thermoanaerobacterales, Erysipelotrichia, Erysipelotrichales, Negativicutes, Selenomonadales, Thermolithobacteria, Fusobacteriia, Fusobacteriales, Leptotrichiaceae, Sebaldella, Sneathia, *Streptobacillus*, Leptotrichia, Fusobacteriaceae, Cetobacterium, *Fusobacterium, Ilyobacter*, Propionigenium, Psychrilyobacter, Longimicrobia, Gemmatimonadetes, Oligosphaeria, Lentisphaeria, Nitrospiria, Nitrospirales, Nitrospiraceae, Phycisphaerae, Planctomycetacia, Alphaproteobacteria, Betaproteobacteria, Hydrogenophilalia, Gammaproteobacteria, Acidithiobacillia, Deltaproteobacteria, Epsilonproteobacteria and Oligoflexia, Spirochaetia, Brachyspirales, Brachyspiraceae, Brevinematales, Brevinemataceae, Leptospirales Leptospiraceae, Spirochaetales, Borreliaceae, Spirochaetaceae, Sarpulinaceae, Synergistia, Synergistales, Synergistaceae, Mollicutes, Thermodesulfobacteria, Thermodesulfobacteriales Thermodesulfobacteriaceae, Thermotogae, Kosmotogales, Kosmotogaceae, Mesoaciditogales, Mesoaciditogaceae, Petrotogales, Petrotogaceae, Thermotogales, Thermotogaceae, Fervidobacteriaceae, Candidatus Epixenosoma, Lentimonas, Methyloacida, Methylacidimicrobium, Methylacidiphilales, Spartobacteria, Opitutae or Verrucomicrobiae. Various genera and species within these classes, orders and families can be selected for analysis using the methods and systems described herein.

Where the cell is a fungal cell, the fungal cell may be from one or more of Blastocladiomycota, Chytridiomycota, Glomeromycota, Microsporidia, Neocallimastigomycota, Dikarya (inc. Deuteromycota), Ascomycota, Pezizomycotina, Saccharomycotina, Taphrinomycotina, Basidiomycota Agaricomycotina, Pucciniomycotina, Ustilaginomycotina, Entomophthoromycotina, Kickxellomycotina, Mucoromycotina, or Zoopagomycotina phyla and subphyla. Illustrative classes, orders and/or families of fungal cells that can be analyzed include, but are not limited to, those from Blastocladiomycetes, Blastocladiales Blastocladiaceae, Catenariaceae, Coelomomycetaceae, Physodermataceae, Sorochytriaceae, Chytridiomycetes, Chytridiales, Cladochytriales, Rhizophydiales, Polychytriales, Spizellomycetales, Rhizophlyctidales, Lobulomycetales, Gromochytriales, Mesochytriales, Synchytriales, Polyphagales, Monoblepharidomycetes, Monoblepharidales, Harpochytriales, Hyaloraphidiomycetes, Hyaloraphidiales, Glomeromycetes, Archaeosporales, Diversisporales, Glomerales, Paraglomerales, Nematophytales, Metchnikovellea, Metchnikovellida Amphiacanthidae, Metchnikovellidae, Microsporea, Cougourdellidae, Facilisporidae, Heterovesiculidae, Myosporidae, Nadelsporidae, Neonosemoidiidae, Ordosporidae, Pseudonosematidae, Telomyxidae, Toxoglugeidae, Tubulinosematidae, Haplophasea, Chytridiopsida, Chytridiopsidae, Buxtehudiidae, Enterocytozoonidae, Burkeidae, Hesseidae, Glugeida, Glugeidae, Gurleyidae, Encephalitozoonidae, Abelsporidae, Tuzetiidae, Microfilidae, Unikaryonidae, Dihaplophasea, Meiodihaplophasida, Thelohanioidea, Thelohaniidae, Duboscqiidae, Janacekiidae, Pereziidae, Striatosporidae, Cylindrosporidae, Burenelloidea, Burenellidae, Amblyosporoidea, Amblyosporidae, Dissociodihaplophasida, Nosematoidea, Nosematidae, Ichthyosporidiidae, Caudosporidae, Pseudopleistophoridae, Mrazekiidae Culicosporoidea, Culicosporidae, Culicosporellidae, Golbergiidae, Spragueidae Ovavesiculoidea, Ovavesiculidae, Tetramicridae, Rudimicrospora, Minisporea, Minisporida, Metchnikovellea, Metchnikovellida, Polaroplasta, Pleistophoridea, Pleistophorida, Disporea, Unikaryotia, Diplokaryotia, Neocallimastigomycetes, Neocallimastigales, Neocallimastigaceae Pezizomycotina, Arthoniomycetes, Coniocybomycetes, Dothideomycetes, Eurotiomycetes, Geoglossomycetes, Laboulbeniomycetes, Lecanoromycetes, Leotiomycetes, Lichinomycetes, Orbiliomycetes, Pezizomycetes, Sordariomycetes, Xylonomycetes Lahmiales, Itchiclahmadion, Triblidiales, Saccharomycotina, Saccharomycetes, Taphrinomycotina Archaeorhizomyces, Neolectomycetes, Pneumocystidomycetes, Schizosaccharomycetes, Taphrinomycetes, Arthoniomycetes, Coniocybomycetes, Dothideomycetes, Eurotiomycetes, Geoglossomycetes, Laboulbeniomycetes, Lecanoromycetes, Leotiomycetes, Lichinomycetes, Orbiliomycetes, Pezizomycetes, Sordariomycetes, Xylonomycetes, Lahmiales, Medeolariales, Triblidiales, Saccharomycetales, Ascoideaceae, Cephaloascaceae, Debaryomycetaceae, Dipodascaceae, Endomycetaceae, Lipomycetaceae, Metschnikowiaceae, Phaffomycetaceae, Pichiaceae, Saccharomycetaceae, Saccharomycodaceae, Saccharomycopsidaceae, Trichomonascaceae, Archaeorhizomycetes, Neolectomycetes, Pneumocystidomycetes, Schizosaccharomycetes, Taphrinomycetes, Agaricomycotina, Pucciniomycotina, Ustilaginomycotina, Wallemiomycetes, Tremellomycetes, Dacrymycetes, Agaricomycetes, Agaricostilbomycetes, Atractiellomycetes, Classiculomycetes, Cryptomycocolacomycetes, Cystobasidiomycetes, Microbotryomycetes, Mixiomycetes, Pucciniomycetes, Tritirachiomycetes, Exobasidiomycetes, Ceraceosorales, Doassansiales, Entylomatales, Exobasidiales, Georgefischeriales, Microstromatales, Tilletiales, Ustilaginomycetes, Urocystales, Ustilaginales, Malasseziomycetes, Malassezioales, Moniliellomycetes, Moniliellales, Basidiobolomycetes, Neozygitomycetes, Entomophthoromycetes, Asellariales, Dimargaritales, Harpellales, Kickxellales, Mortierellomycetes, Mortierellales, Mucoromycetes, Mucorales, or Endogonales. Various genera and species within these classes, orders and families can be selected for analysis using the methods and systems described herein.

Where the cell is a plant cell, the plant cell may be from one or more of Nematophytes, Chlorophyta, Palmophyllales, Prasinophyceae, Nephroselmidophyceae, Pseudoscourfieldiales, Pyramimonadophyceae, Mamiellophyceae, Scourfieldiales, Pedinophyceae, Chlorodendrophyceae, Trebouxiophyceae, Ulvophyceae, Chlorophyceae, Streptophyta, Chlorokybophyta, Mesostigmatophyta, Klebsormidiophyta, Charophyta, Chaetosphaeridiales, Coleochaetophyta, Zygnematophyta, or Embryophyta phyla and subphyla. Illustrative classes, orders, families and genera of plant cells that can be analyzed include, but are not limited to, those from Nematothallus, Cosmochlaina, Nematophytaceae, Nematoplexus, Nematasketum, Prototaxites, Ulvophyceae, Trebouxiophyceae, Chlorophyceae, Chlorodendrophyceae, Mamiellophyceae, Nephroselmidophyceae, Palmophyllales, Pedinophyceae, Prasinophyceae, Pseudoscourfieldiales, Pyramimonadophyceae, Scourfieldiales, Palmoclathrus, Palmophyllum, Verdigellas, Prasinococcales, Prasinophyceae incertae sedis, Pseudoscourfieldiales, Pyramimonadales, Nephoselmis, Pycnococcaceae, Scourfieldiaceae, Pedinomonas, Resultor, Marsupiomonas, Chlorochtridion tuberculatum, Chlorellales, Prasiolales, Trebouxiales, Bryopsidales, Cladophorales, Dasycladales, Oltmannsiellopsidales, Scotinosphaerales, Trentepohliales, Ulotrichales, Ulvales, Chaetopeltidales, Chaetophorales, Chlamydomonadales, Chlorococcales, Chlorocystidales, Microsporales, Oedogoniales, Phaeophilales, Sphaeropleales, Tetrasporales, Chlorokybus, Mesostigmatophyceae, Entransia, Hormidiella, Interfilum, Klebsormidium, Mesostigmatophyceae, Klebsormidiophyceae, Zygnematophyceae, ZygnematalesDesmidiales, Charophyceae, Charales, Chlorokybophyceae, Coleochaetales, Polychaetophora, Chaetosphaeridium, Coleochaetophyceae, Zygnematales, Desmidiales, Bryophytes, Marchantiophyta, Bryophyta, Anthocerotophyta, Horneophytopsida, Tracheophytes, Rhyniophyta, Zosterophyllophyta, Lycopodiophyta, Trimerophytophyta, Pteridophyta, Spermatophytes, Pteridospermatophyta, Pinophyta, Cycadophyta, Ginkgophyta, Gnetophyta, or Magnoliophyta. Various species within these classes, orders, families and genera can be selected for analysis using the methods and systems described herein.

In some examples, one or more analytes in a plant organelle can be quantified using the methods and systems described herein. For example, a plant organelle can include, but is not limited to, plant cell nucleus, nuclear membrane, a nuclear membrane, endoplasmic reticulum, ribosome, mitochondria, vacuole, chloroplast, cell membrane or cell wall. The plant organelle may be separated from the other material of the cell so the analytes of the isolated plant organelle can be quantified.

Where the cell is an animal cell, the animal cell may be an embryonic stem cell, an adult stem cell, a tissue-specific stem cell, a mesenchymal stem cell, an induced pluripotent stem cells, an epithelial tissue cell, a connective tissue cell, a muscle tissue cell, or a nervous tissue cell. The animal cell can be derived from ectoderm, endoderm or mesoderm. Ectoderm derived cells include, but are not limited to, skin cells, anterior pituitary cells, peripheral nervous system cells, neuroendocrine cells, teeth, eye cells, central nervous system cells, ependymal cells and pineal gland cells. Endoderm derived cells include, but are not limited to, respiratory cells, stomach cells, intestine cells, liver cells, gallbladder cells, exocrine pancreas cells, Islets of Langerhans cell, thyroid gland cells and urothelial cells. Mesoderm derived cells include, but are not limited to, osteochondroprogenitor cells, myofibroblast, angioblasts, stromal cells, *Macula densa*, cells, interstitial cells, telocytes, podocytes, Sertoli cells, Leydig cells, Granulosa cells, Peg cells, germ cells, hematopoietic stem cells, lymphoid cells, myeloid cells, endothelial progenitor cells, endothelial colony forming cells, endothelial stem cell, angioblast/mesoangioblast cells, pericyte cells and mural cells.

In some instances, an organelle of an animal cell is isolated from other components of the animal cell and then two or more analytes in the isolated animal organelle are quantified using the methods and systems described herein. For example, the isolated organelle can include, but is not limited to, animal cell nucleus, nuclear membrane, a nuclear membrane, endoplasmic reticulum, sarcoplasmic reticulum, ribosome, mitochondria, vacuole, lysosome, or cell membrane.

Where viruses are analyzed, the virus may be, for example, a double stranded DNA virus, a single stranded DNA virus, a double stranded RNA virus, a positive sense single stranded RNA virus, a negative sense single stranded RNA virus, a single stranded RNA-reverse transcribing virus (retrovirus) or a double stranded DNA reverse transcribing virus. Various specific viruses include, but are not limited to, Papovaviridae, Adenoviridae, Herpesviridae, Herpesvirales, Ascoviridae, Ampullaviridae, Asfarviridae, Baculoviridae, Fuselloviridae, Globuloviridae, Guttaviridae, Hytrosaviridae, Iridoviridae, Lipothrixviridae, Nimaviridae, Poxviridae, Tectiviridae, Corticoviridae, Sulfolobus, Caudovirales, Corticoviridae, Tectiviridaea, Ligamenvirales, Ampullaviridae, Bicaudaviridae, Clavaviridae, Fuselloviridae, Globuloviridae, Guttaviridae, Turriviridae, Ascovirus, Baculovirus, Hytrosaviridae, Iridoviridae, Polydnaviruses, Mimiviridae, Marseillevirus, Megavirus, Mavirus virophage, Sputnik virophage, Nimaviridae, Phycodnaviridae, pleolipoviruses, Plasmaviridae, Pandoraviridae, Dinodnavirus, Rhizidiovirus, Salterprovirus, Sphaerolipoviridae, Anelloviridae, Bidnaviridae, Circoviridae, Geminiviridae, Genomoviridae, Inoviridae, Microviridae, Nanoviridae, Parvoviridae, Spiraviridae, Amalgaviridae, Birnaviridae, Chrysoviridae, Cystoviridae, Endornaviridae, Hypoviridae, Megabirnaviridae, Partitiviridae, Picobirnaviridae, Quadriviridae, Reoviridae, Totiviridae, Nidovirales, Picornavirales, Tymovirales, Mononegavirales, Bornaviridae, Filoviridae, Mymonaviridae, Nyamiviridae, Paramyxoviridae, Pneumoviridae, Rhabdoviridae, Sunviridae, Anphevirus, Arlivirus, Chengtivirus, Crustavirus, Wastrivirus, Bunyavirales, Feraviridae, Fimoviridae, Hantaviridae, Jonviridae, Nairoviridae, Peribunyaviridae, Phasmaviridae, Phenuiviridae, Tospoviridae, Arenaviridae, Ophioviridae, Orthomyxoviridae, Deltavirus, Taastrup virus, Alpharetrovirus, Avian leukosis virus; Rous sarcoma virus, Betaretrovirus, Mouse mammary tumor virus, Gammaretrovirus, Murine leukemia virus, Feline leukemia virus, Bovine leukemia virus, Human T-lymphotropic virus, Epsilonretrovirus, Walleye dermal sarcoma virus, Lentivirus, Human immunodeficiency virus 1, Simian and Feline immunodeficiency viruses, Spumavirus, Simian foamy virus, Orthoretrovirinae, Spumaretrovirinae, Metaviridae, Pseudoviridae, Retroviridae, Hepadnaviridae, or Caulimoviridae. Various species within these classes, orders, families and genera can be selected for analysis using the methods and systems described herein.

The methods and systems described herein may also be used to measure one, two, three or more analytes present in a colloid. A colloid may comprise mixtures of solid particles dispersed in a liquid medium. The solid particles are generally insoluble in the liquid medium but remained dispersed or suspended in the liquid medium. Individual solid particles of the colloid can be used for analysis/detection of two or more analytes or mixtures of the solid particles can be used for analysis/detection of two or more analytes. Colloids are prevalent in the food science, cosmetics and personal care industries in various materials including shaving creams, whipped cream, styrofoam, pumice, agar, gelatin, jellies, hand creams, milk, mayonnaise, pigmented inks, blood, smoke, clouds, aerogels, hydrogels, certain silicates and glasses and similar materials.

Certain specific examples are described to illustrate further some of the aspects, embodiments and configurations described herein.

Example 1

Figure 16:
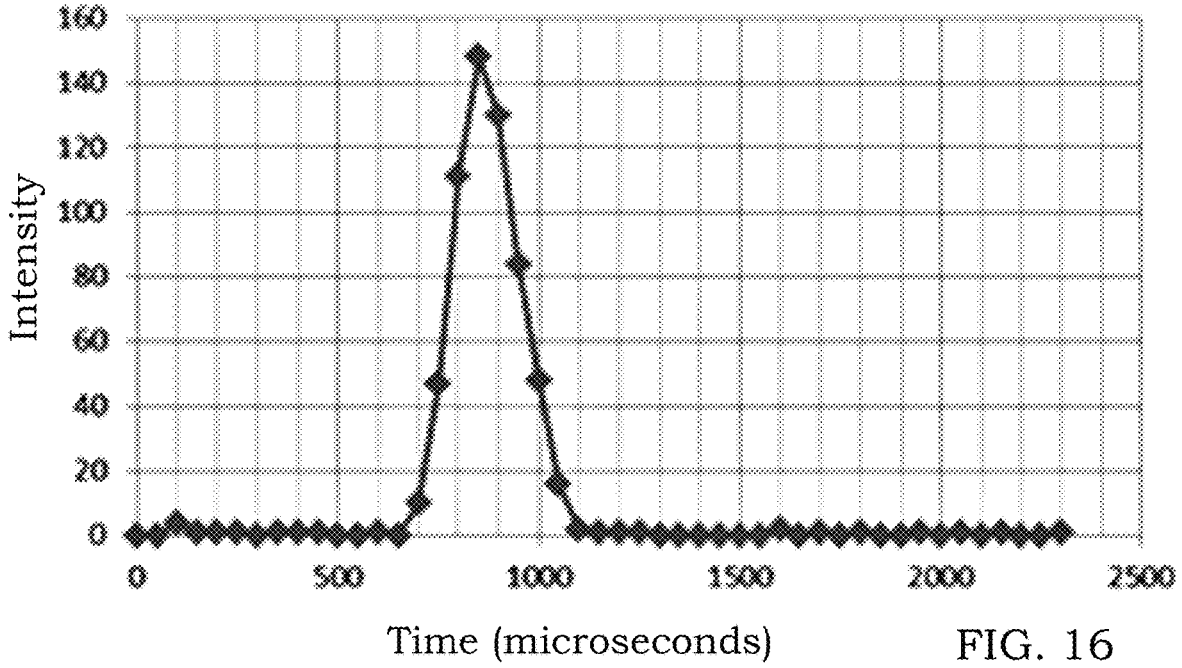
FIG. 16 is a graph showing data values and a pre-scan curve obtained in a single analyte mode, in accordance with certain examples.

Referring to FIG. 16, a graph is shown where detection values for a transient event are fully captured for a single analyte. There are no gaps in detection values, so a curve can be generated to quantify the amount of the single analyte present in the transient sample. Peak height or peak area or both of the curve can be used to determine the amount of the single analyte present in the sample. As shown in FIG. 16, the duration of such transient events can be in the 400 microseconds up to a few milliseconds range. Such fast transient events can easily be handled and quantified in the single analyte mode, but quantification in the case of analyzing two or more analytes in the transient sample can be difficult as the sequential mass analyzer is switching from one analyte to another analyte.

Example 2

Figure 17:
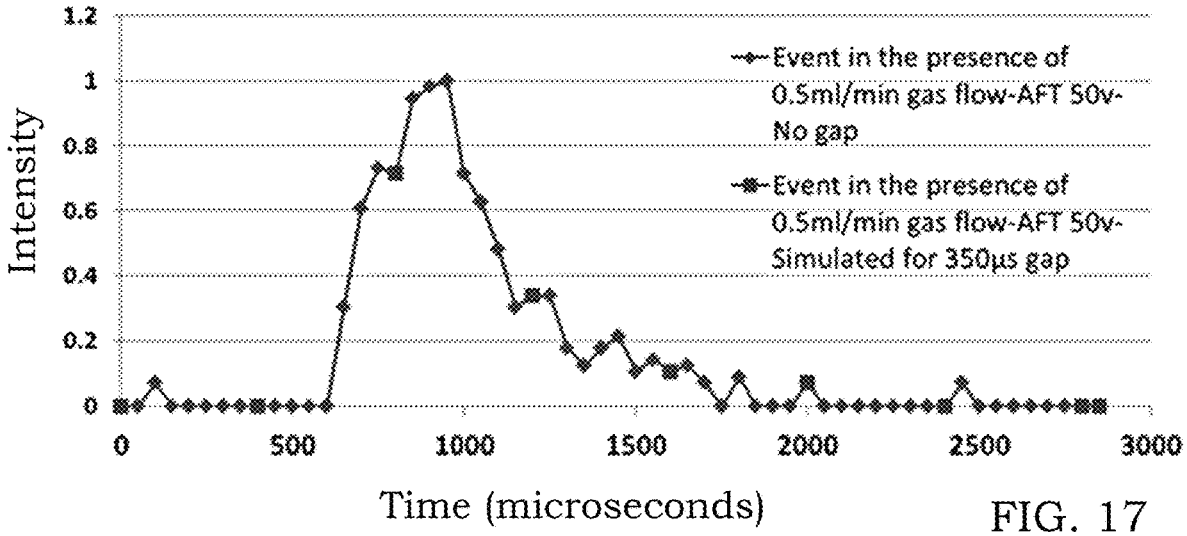
FIG. 17 is a graph showing detection value gaps for a single analyte, in accordance with certain embodiments.

Referring to FIG. 17, a simulation is shown where a gas is introduced into a collision-reaction cell to pressurize the cell. Collision-reaction cell pressurization induces ion collisions with a gas to slow down the event and increase its duration. The axial field strength can be altered, along with the gas density/flow to increase the duration of the event to a point that the transient event can be sampled multiple times (at least more than once). As shown in FIG. 17, even where a simulated data gap of 350 microseconds is assumed (which can be the time it takes to switch and scan/detect a second analyte and switch back), more than one non-zero detection value is obtained for the first analyte. This simulation used a 0.5 mL/min gas ($NH_3$) introduced into the collision-reaction cell and +50V provided to the axial electrodes.

Example 3

Figure 18:
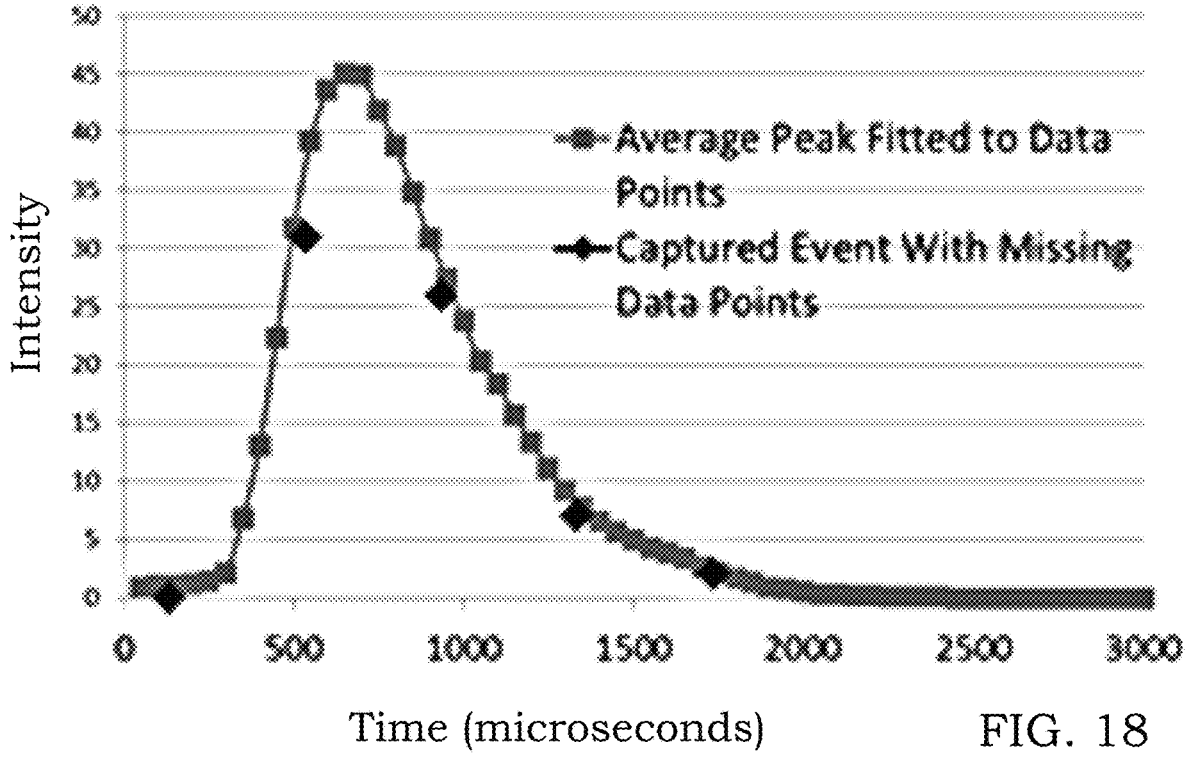
FIG. 18 is a graph showing an intensity curve generated using detection values obtained for a single analyte, in accordance with certain examples.

Another simulation was performed to fit an intensity curve to captured detection values with missing detection value gaps. As shown in FIG. 18, an intensity curve can be fitted to the captured detection values in the dual analyte mode (labeled as captured event with missing data points). The intensity curve shape can be based, at least in part, on the curve shape obtained in the single analyte mode or can be based on fitting a suitable curve to the captured data points.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, configurations, examples and embodiments have been described above, it will be recognized by the person of ordinary skill in the art, given the benefit of this disclosure, that additions, substitutions, modifications, and alterations of the disclosed illustrative aspects, configurations, examples and embodiments are possible.

What is claimed is:

1. A method of quantifying a transient event representative of two or more analytes in a transient sample using a mass spectrometer, the method comprising:

broadening an ion cloud by differentially decreasing an ion velocity of different analyte ions in an ion cloud in a collision-reaction cell by pressurizing the collision-reaction cell with a gas, the ion cloud comprising ions from a first analyte of the transient sample and ions from a second analyte of the transient sample;

providing the broadened ion cloud comprising the different ions of differentially decreased ion velocity from the collision-reaction cell to a mass analyzer fluidically coupled to the collision-reaction cell downstream of the collision-reaction cell to alternately select between the ions from the first analyte and the ions from the second analyte using the mass analyzer;

providing the alternately selected ions from the first analyte and the ions from the second analyte from the mass analyzer to a downstream detector fluidically coupled to the mass analyzer to detect the provided ions from the first analyte as first detection values during a detection period and to detect the provided ions from the second analyte as second detection values during the detection period;

generating a first intensity curve, using the detected first detection values, that is representative of the first analyte in the sample;

generating a second intensity curve, using the detected second detection values, that is representative of the second analyte in the sample;

determining an amount of the first analyte in the transient sample using the generated first intensity curve and determining an amount of the second analyte in the transient sample using the second generated intensity curve.

2. The method of claim 1, further comprising using a first analyte pre-scan curve to determine a shape of the generated first intensity curve and using a second analyte pre-scan curve to determine a shape of the second generated intensity curve.

3. The method of claim 2, further comprising using peak height of the first generated intensity curve to determine the amount of first analyte.

4. The method of claim 3, further comprising using peak height of the second generated intensity curve to determine the amount of second analyte.

5. The method of claim 2, further comprising using area under the generated first intensity curve to determine the amount of first analyte.

6. The method of claim 5, further comprising using area under the generated second intensity curve to determine the amount of second analyte.

7. The method of claim 1, further comprising altering an axial field strength within the collision-reaction cell to further broaden the ion cloud in the collision-reaction cell.

8. The method of claim 1, further comprising lowering a voltage provided to axial electrodes within the collision-reaction cell to alter the axial field strength within the collision-reaction cell.

9. The method of claim 1, further comprising altering a sampling depth of the mass spectrometer to further broaden the ion cloud.

10. The method of claim 1, further comprising configuring the transient sample to comprise a single nanoparticle, a single nanostructure, a single microparticle, a single microstructure, a single cell or a single organelle of a cell.

11. A method of quantifying two or more inorganic analytes in a transient sample using a mass spectrometer, wherein the transient sample comprises a first inorganic analyte and a second inorganic analyte each present in a single system, the method comprising:

introducing the single system into an ionization source to ionize the first inorganic analyte and the second inorganic analyte and provide an ion cloud comprising ionized first inorganic analyte and ionized second inorganic analyte;

providing the ion cloud comprising the ionized first inorganic analyte and the ionized second inorganic analyte to a collision-reaction cell fluidically coupled to the ionization source and downstream from the ionization source;

broadening the provided ion cloud in the collision-reaction cell;

providing the broadened ion cloud from the collision-reaction cell to the mass analyzer fluidically coupled to the collision-reaction cell downstream of the collision-reaction cell to alternately select between ions from the ionized first inorganic analyte and ions from the ionized second inorganic analyte using the mass analyzer;

providing the alternately selected ions from the ionized first inorganic analyte and the ions from the ionized second inorganic analyte from the mass analyzer to a downstream detector fluidically coupled to the mass analyzer to detect the provided ions from the ionized first inorganic analyte as first detection values during a detection period and to detect the ions from the provided ionized second inorganic analyte as second detection values during the detection period;

generating a first intensity curve, using the detected first detection values, that is representative of the first inorganic analyte in the single system;

generating a second intensity curve, using the detected second detection values, that is representative of the second inorganic analyte in the single system;

determining an amount of the first analyte in the single system using the generated first intensity curve and determining an amount of the second analyte in the single system using the generated second intensity curve.

12. The method of claim 11, further comprising broadening the provided ion cloud in the collision-reaction cell by altering pressure in the collision-reaction cell or altering axial field strength in the collision-reaction cell or both to differentially decrease ion velocity of ions in the provided ion cloud.

13. The method of claim 12, further comprising using a first analyte pre-scan curve to determine a shape of the generated first intensity curve and using a second analyte pre-scan curve to determine a shape of the second generated intensity curve.

14. The method of claim 13, further comprising using peak height of the first generated intensity curve to determine the amount of first analyte.

15. The method of claim 14, further comprising using peak height of the second generated intensity curve to determine the amount of second analyte.

16. The method of claim 13, further comprising using area under the generated first intensity curve to determine the amount of first analyte.

17. The method of claim 16, further comprising using area under the generated second intensity curve to determine the amount of second analyte.

18. The method of claim 11, further comprising altering a sampling depth of the mass spectrometer to broaden the ion cloud prior to providing to providing the ion cloud to the collision-reaction cell.

19. The method of claim 18, further comprising providing the ion cloud to an ion deflector positioned upstream of the collision-reaction cell.

20. The method of claim 11, further comprising configuring the single system to comprise a single nanoparticle, a single nanostructure, a single microparticle, a single microstructure, a single cell or a single organelle of a cell.

* * * * *